US006773517B2

(12) United States Patent
Sakaki et al.

(10) Patent No.: US 6,773,517 B2
(45) Date of Patent: Aug. 10, 2004

(54) RARE-EARTH ALLOY, RATE-EARTH SINTERED MAGNET, AND METHODS OF MANUFACTURING

(75) Inventors: Kazuaki Sakaki, Takefu (JP); Koji Sato, Takefu (JP); Takahiro Hashimoto, Takefu (JP); Hajime Nakamura, Takefu (JP); Takehisa Minowa, Takefu (JP)

(73) Assignee: Shin-Etsu Chemical Co, Ltd., Tokyo (JP)

( * ) Notice: Subject to any disclaimer, the term of this patent is extended or adjusted under 35 U.S.C. 154(b) by 103 days.

(21) Appl. No.: 09/948,914

(22) Filed: Sep. 10, 2001

(65) Prior Publication Data

US 2002/0054825 A1 May 9, 2002

(30) Foreign Application Priority Data

Sep. 8, 2000 (JP) ..... 2000-272658
Sep. 8, 2000 (JP) ..... 2000-272665
Sep. 8, 2000 (JP) ..... 2000-272667
Sep. 8, 2000 (JP) ..... 2000-273194

(51) Int. Cl.[7] ..... H01F 1/055
(52) U.S. Cl. ..... 148/303; 148/101; 164/463
(58) Field of Search ..... 148/303, 313, 148/315, 101; 420/93, 83; 164/463

(56) References Cited

U.S. PATENT DOCUMENTS 5,888,417 A * 3/1999 Akioka et al. ..... 252/62.55
6,001,272 A * 12/1999 Ikuma et al. ..... 252/62.54
6,319,335 B1 * 11/2001 Hirota et al. ..... 148/302
6,423,386 B2 * 7/2002 Iwasaki et al. ..... 128/34.5
6,475,302 B2 * 11/2002 Mei et al. ..... 148/303
6,565,673 B1 * 5/2003 Gong et al. ..... 148/303

FOREIGN PATENT DOCUMENTS

JP 8-260083 10/1996
JP 9-111383 4/1997

OTHER PUBLICATIONS

Abstract of Japanese 9–111383.
Abstract of Japanese 8–260083.
XP—002250138—Abstract of Japan 57104203.
XP—002250139—Abstract of Japan 3198306.

* cited by examiner

*Primary Examiner*—John P. Sheehan
(74) *Attorney, Agent, or Firm*—Millen, White, Zelano & Branigan, P.C.

(57) ABSTRACT

A rare-earth alloy ingot is produced by melting an alloy composed of 20–30 wt % of a rare-earth constituent which is Sm alone or at least 50 wt % Sm in combination with at least one other rare-earth element, 10–45 wt % of Fe, 1–10 wt % of Cu and 0.5–5 wt % of Zr, with the balance being Co, and quenching the molten alloy in a strip casting process. The strip-cast alloy ingot has a content of 1–200 μm size equiaxed crystal grains of at least 20 vol % and a thickness of 0.05–3 mm. Rare-earth sintered magnets made from such alloys exhibit excellent magnetic properties and can be manufactured under a broad optimal temperature range during sintering and solution treatment.

13 Claims, 15 Drawing Sheets

100 μm

100 μm

100 μm

100 μm

100 μm

100 μm

100 μm

100 μm

RARE-EARTH ALLOY, RATE-EARTH SINTERED MAGNET, AND METHODS OF MANUFACTURING

BACKGROUND OF THE INVENTION

1. Field of the Invention

The present invention relates to rare-earth alloys and a method of manufacturing such alloys. The invention also relates to $Sm_2Co_{17}$-based sintered magnets and a method of manufacturing such magnets.

2. Prior Art

The sintered magnet materials used in $Sm_2Co_{17}$-based permanent magnets are typically produced by a process which includes milling an alloy ingot of a regulated composition to a particle size of 1 to 10 $\mu$m, pressing and shaping the resulting powder in a magnetic field to form a powder compact, sintering the powder compact in an argon atmosphere at 1100 to 1300° C., and typically about 1200° C., for a period of 1 to 5 hours, then solution-treating the sintered compact. Next, the solution-treated compact is generally subjected to aging treatment in which it is held at a temperature of 700 to 900° C., and typically about 800° C., for about 10 hours, then gradually cooled to 400° C. or less at a rate of −1.0° C./min. In a conventional process of this type, sintering and solution treatment must be carried out under strict temperature control within an optimal range of ±3° C. about the temperature setting. The reason is that, during sintering and solution treatment, the presence of a plurality of different constituent phases gives rise to local heat treatment temperature-sensitive variations in crystal grain growth and phase transitions. Moreover, temperature control during sintering and solution treatment tends to become even more rigorous for $Sm_2Co_{17}$-based sintered magnets of higher magnetic properties. A uniform alloy structure that is as free of segregation as possible is essential for maintaining the treatment temperature with the optimal temperature range and achieving good magnetic properties.

One casting technique used to obtain $Sm_2Co_{17}$-based magnet alloys having a uniform structure involves casting an alloy melt into a mold having a box-like or other suitable shape so as to form a macroscopic structure composed of columnar crystals. In such a process, the cooling rate of the alloy melt must be increased to some degree in order to form columnar crystals. Yet, in a casting process carried out using a box-shaped mold, the inner portions of the ingot tend to cool more slowly than the cooling rate at which columnar crystals form, resulting in a larger grain size and the formation of equiaxed crystals. One way to overcome this problem is to reduce the thickness of the ingot, but doing so lowers the production efficiency. Hence, ingots having a substantial degree of thickness are generally produced, often resulting in a coarser structure and the formation of equiaxed crystals. Coarsening of the structure and equiaxed crystal formation leads to segregation within the ingot, which adversely impacts the magnet structure following sintering and solution treatment, making it difficult to achieve good magnetic properties.

One solution that has been proposed is a single-roll strip casting process (JP-A 8-260083). Ingots produced by this process have a fine crystal structure and a uniform alloy structure free of segregation. However, it has been shown that sintered magnets produced from ingots with a microcrystalline structure as the starting material, while having a better coercivity than sintered magnets made from ingots cast in a box-shaped mold, have an inferior residual flux density and maximum energy product (JP-A 9-111383). Ingots with a microcrystalline structure have a much smaller average crystal grain size than ingots cast in a box-shaped mold. When these respective types of ingots are each milled into fine powders having an average particle size of 5 $\mu$m during sintered magnet production, the average crystal grain size and the average particle size of the fine powder obtained by milling are similar for those ingots having a microcrystalline structure. Hence, the milled particles are not all single crystals; a greater proportion are polycrystalline, which lowers the degree of orientation when the powder is compacted in a magnetic field. The sintered magnet obtained after heat treatment thus has a lower degree of orientation, and ultimately a lower residual flux density and maximum energy product. For this reason, strip-cast ingots are not used as the starting material in the production of $Sm_2Co_{17}$-based sintered magnets.

Regardless of whether an ingot cast in a box-shaped mold or an ingot made by a strip casting process is used, the constituent phases of the $Sm_2Co_{17}$-based permanent magnet alloy after it has been cast are the same, and include a $Th_2Zn_{17}$ phase, a $Th_2Ni_{17}$ phase, a 1:7 phase, a 1:5 phase, a 2:7 phase and a 1:3 phase. Strict temperature control is required, with the optimal temperature range during sintering and solution treatment being ±3° C.

SUMMARY OF THE INVENTION

It is therefore an object of the present invention to provide a rare-earth alloy which can be uniformly treated in a short period of time when heat treated as a thin strip-like ingot. It is also an object of the invention to provide a method of manufacturing such alloys.

Another object of the invention is to provide a rare-earth sintered magnet having excellent magnetic properties. An additional object of the invention is to provide a method of manufacturing such magnets.

A further object is to provide a rare-earth sintered magnet having a broad optimal temperature range for sintering and solution treatment, thereby making it possible to ease the heat temperature conditions, and in turn improving productivity. A still further object is to provide a method of manufacturing such magnets.

We have extensively studied the relationship between the alloy structure in $Sm_2Co_{17}$-based alloys and the structural changes that take place in such alloys when heat treated. As a result, We have found that heat treatment can be completed in a short time and a uniform structure easily achieved by the use of a $Sm_2Co_{17}$-based alloy ingot having a content of 1 to 200 $\mu$m size equiaxed crystal grains of at least 20 vol % and a thickness of 0.05 to 3 mm.

We have also found that when such an alloy is heat-treated in a non-oxidizing atmosphere to increase the average crystal grain size, a sintered magnet can be produced which has better magnetic properties than sintered magnets produced from prior-art cast ingots.

Another discovery I have made is that a sintered magnet endowed with better magnetic properties than sintered magnets made from prior-art cast ingots can be produced by heat-treating a $Sm_2Co_{17}$-based magnet alloy having a fine-grained structure, that is, a $Sm_2Co_{17}$-based magnet alloy obtained by a strip casting process, under optimal conditions in a non-oxidizing atmosphere to increase the average crystal grain size.

In addition, I have extensively studied the relationship between alloy structure and magnetic properties in $Sm_2Co_{17}$-based sintered magnets, as a result of which I have discovered that by having a $TbCu_7$-type crystal structure (referred to hereinafter as a "1:7 phase") account for at least 50 vol % of the constituent phases in the starting ingot used in $Sm_2Co_{17}$-based sintered magnet production, better magnetic properties can be achieved than when sintered magnets are produced using prior-art cast ingots, or even when other constituent phases are allowed to serve as the major phase. This is because the 1:7 phase in a $Sm_2Co_{17}$-based magnet alloy has a better orientability during molding of the alloy in a magnetic field than do the other constituent phases (such as the 2:17 phase, 1:5 phase, 2:7 phase and 1:3 phase); indeed, the higher the proportion of 1:7 phase in the $Sm_2Co_{17}$-based magnet alloy, the better the magnetic properties that can be achieved. Furthermore, by having the 1:7 phase account for at least 50 vol % of the constituent phases, when sintering and solution treatment are carried out, local heat treatment temperature-sensitive variations do not arise in crystal grain growth and phase transitions. This allows some easing of the optimal temperature conditions for heat treatment, which until now have had to be strictly controlled.

Accordingly, in a first aspect, the invention provides a rare-earth alloy ingot made by melting an alloy composed mainly of 20 to 30 wt % of a rare-earth component R is samarium alone or at least 50 wt % samarium in combination with at least one other rare-earth element, 10 to 45 wt % of iron, 1 to 10 wt % of copper and 0.5 to 5 wt % of zirconium, with the balance being cobalt; and quenching the molten alloy in a strip casting process. The ingot has a content of 1 to 200 $\mu$m size equiaxed crystal grains of at least 20 vol %, and a thickness of 0.05 to 3 mm.

In a second aspect, the invention provides a method of manufacturing rare-earth alloy ingots, which method includes the steps of melting an alloy composed mainly of 20 to 30 wt % of a rare-earth component R which is samarium alone or at least 50 wt % samarium in combination with at least one other rare-earth element, 10 to 45 wt % of iron, 1 to 10 wt % of copper and 0.5 to 5 wt % of zirconium, with the balance being cobalt; and strip-casting the molten alloy at a melt temperature of 1250 to 1600° C. The ingot has a content of 1 to 200 $\mu$m size equiaxed crystal grains of at least 20 vol %, and a thickness of 0.05 to 3 mm.

In a third aspect, the invention provides a method of manufacturing rare-earth sintered magnets, which method includes the steps of melting an alloy composed mainly of 20 to 30 wt % of a rare-earth component R which is samarium alone or at least 50 wt % samarium in combination with at least one other rare-earth element, 10 to 45 wt % of iron, 1 to 10 wt % of copper and 0.5 to 5 wt % of zirconium, with the balance being cobalt; quenching the molten alloy by a strip casting process so as to form a rare-earth alloy ingot which has a content of 1 to 200 $\mu$m size equiaxed crystal grains of at least 20 vol % and a thickness of 0.05 to 3 mm; heat-treating the ingot in a non-oxidizing atmosphere at 1000 to 1300° C. for 0.5 to 20 hours to form a rare-earth magnet alloy; milling the rare-earth magnet alloy; compression-molding the milled alloy in a magnetic field to form a powder compact; sintering the compact; subjecting the sintered compact to solution treatment; and aging the solution-treated compact.

When a $Sm_2Co_{17}$-based alloy is subjected to high-temperature heat treatment for an extended period of time, the samarium undergoes evaporation on account of its very high vapor pressure, altering the composition of the magnets produced, which may lead to a deterioration in the magnetic properties, such as variable coercivities. On the other hand, low-temperature, short-duration heat treatment carried out to avoid samarium evaporation fails to provide a sufficient heat treatment effect, which leads to declines in the residual flux density and maximum energy product. Use of the alloy ingot according to the first aspect of the invention allows optimal heat treatment to be carried out in a short period of time, enabling the crystal grain size to be increased without unwanted changes in composition. Moreover, such $Sm_2Co_{17}$-based magnet alloys, when subsequently subjected to milling, molding of the milled powder in a magnetic field, sintering of the molded powder compact, solution treatment and aging treatment, can be used to produce $Sm_2Co_{17}$-based sintered magnets having excellent magnetic properties.

In a fourth aspect, the invention provides a method of manufacturing rare-earth permanent magnets, which method includes the steps of using a strip-casting process to form an alloy consisting essentially of 20 to 30 wt % of a rare-earth component R which is samarium alone or at least 50 wt % samarium in combination with at least one other rare-earth element, 10 to 45 wt % of iron, 1 to 10 wt % of copper and 0.5 to 5 wt % of zirconium, with the balance being cobalt and inadvertent impurities; heat-treating the strip-cast alloy in a non-oxidizing atmosphere at 1000 to 1300° C. for 0.5 to 20 hours to form a rare-earth magnet alloy having an average grain size of 20 to 300 $\mu$m; milling the rare-earth magnet alloy; compression-molding the milled alloy in a magnetic field to form a powder compact; sintering the compact; subjecting the sintered compact to solution treatment; and aging the solution-treated compact.

The foregoing method overcomes the deterioration in magnetic properties which is characteristic of sintered magnets obtained from conventional ingots cast in box-shaped molds, and is attributable in part to undesirable effects at the interior of the ingot such as coarsening of the structure and segregation of the composition owing to the formation of equiaxed crystals. Moreover, it avoids a problem normally associated with ingots having a microcrystalline structure that are produced by a single-roll strip casting process; namely, the formation of milled powder particles which are polycrystalline. Polycrystallinity is undesirable because it lowers the degree of orientation by the particles when the milled powder is pressed and shaped in a magnetic field, resulting in a low degree of orientation in the sintered magnet after heat treatment, which in turn lowers the residual flux density and the maximum energy product of the magnet. Hence, the rare-earth permanent magnet production method according to the fourth aspect of the invention can be used to produce $Sm_2Co_{17}$-based sintered magnets having excellent magnetic properties.

In a fifth aspect, the invention provides a method of manufacturing rare-earth sintered magnets, which method includes the steps of using a strip-casting process to form an alloy having the compositional formula:

$$R(Co_{(1-a-b-c)}Fe_aCu_bZr_c)_z$$

wherein R is samarium alone or at least 50 wt % samarium in combination with at least one other rare-earth element, and the letters a, b, c and z are positive numbers which satisfy the following conditions $0.1 \leqq a \leqq 0.35$, $0.02 \leqq b$ 0.08, $0.01 \leqq c \leqq 0.05$, and $7.0 \leqq z 9.0$; heat-treating the strip-cast alloy at 1100 to 1250° C. for 1 to 20 hours in a non-oxidizing atmosphere to form a rare-earth magnet alloy having a $TbCu_7$-type crystal structure of at least 50 vol %; milling the rare-earth magnet alloy; compression-molding the milled alloy in a magnetic field to form a powder compact; sintering the compact; subjecting the sintered compact to solution treatment; and aging the solution-treated compact.

The foregoing method resolves the deterioration in magnetic properties which is characteristic of sintered magnets obtained from conventional ingots cast in box-shaped molds, and is attributable in part to undesirable effects at the interior of the ingot such as coarsening of the structure and to segregation of the composition owing to the formation of equiaxed crystals. Moreover, it eases the optimal temperature conditions for sintering and solution treatment which until now have had to be strictly controlled, thus enhancing productivity.

In a sixth aspect, the invention provides an anisotropic rare-earth sintered magnet which has been produced by milling a $Sm_2Co_{17}$-based permanent magnet alloy, followed by molding, sintering, solution treatment and aging treatment, the alloy consisting essentially of 20 to 30 wt % of a rare-earth component R which is samarium alone or at least 50 wt % samarium in combination with at least one other rare-earth element, 10 to 45 wt % of iron, 1 to 10 wt % of copper, 0.5 to 5 wt % of zirconium and 0.01 to 1.0 wt % of titanium, with the balance being cobalt and inadvertent impurities, which alloy has a $TbCu_7$-type crystal structure content of at least 50 vol %. The magnet has a maximum energy product $(BH)_{max}$ of at least 25 MGOe. The alloy of which the magnet is made has an average crystal grain size of preferably 20 to 300 $\mu$m.

In a seventh aspect, the invention provides a method of manufacturing an anisotropic rare-earth sintered magnet having a maximum energy product $(BH)_{max}$ of at least 25 MGOe, which method includes the steps of heat-treating a $Sm_2Co_{17}$-based permanent magnet alloy consisting essentially of 20 to 30 wt % of a rare-earth component R which is samarium alone or at least 50 wt % samarium in combination with at least one other rare-earth element, 10 to 45 wt % of iron, 1 to 10 wt % of copper, 0.5 to 5 wt % of zirconium and 0.01 to 1.0 wt % of titanium, with the balance being cobalt and inadvertent impurities, at 1100 to 1250° C. for 0.5 to 20 hours to give the alloy a $TbCu_7$-type crystal structure content of at least 50 vol %; milling the magnet alloy; molding the milled alloy to form a powder compact; sintering the compact; solution-treating the sintered compact; and carrying out aging treatment on the solution-treated compact.

The foregoing method overcomes the deterioration in magnetic properties which is characteristic of sintered magnets obtained from conventional ingots cast in box-shaped molds, and is attributable in part to undesirable effects at the interior of the ingot such as coarsening of the structure and segregation of the composition owing to the formation of equiaxed crystals. Moreover, it eases the optimal temperature conditions for sintering and solution treatment which until now have had to be strictly controlled, thus enhancing productivity. Additionally, by setting the average crystal grain size within a range of 20 to 300 $\mu$m, milling does not result in the formation of a polycrystalline powder which would lower the degree of orientation during molding of the powder in a magnetic field, lower the degree of orientation in the sintered magnet following heat treatment, and ultimately lower the residual flux density and maximum energy product. Accordingly, $Sm_2Co_{17}$-based sintered magnets having excellent magnetic properties can be obtained.

BRIEF DESCRIPTION OF THE DIAGRAMS

DETAILED DESCRIPTION OF THE INVENTION

Figure 1:
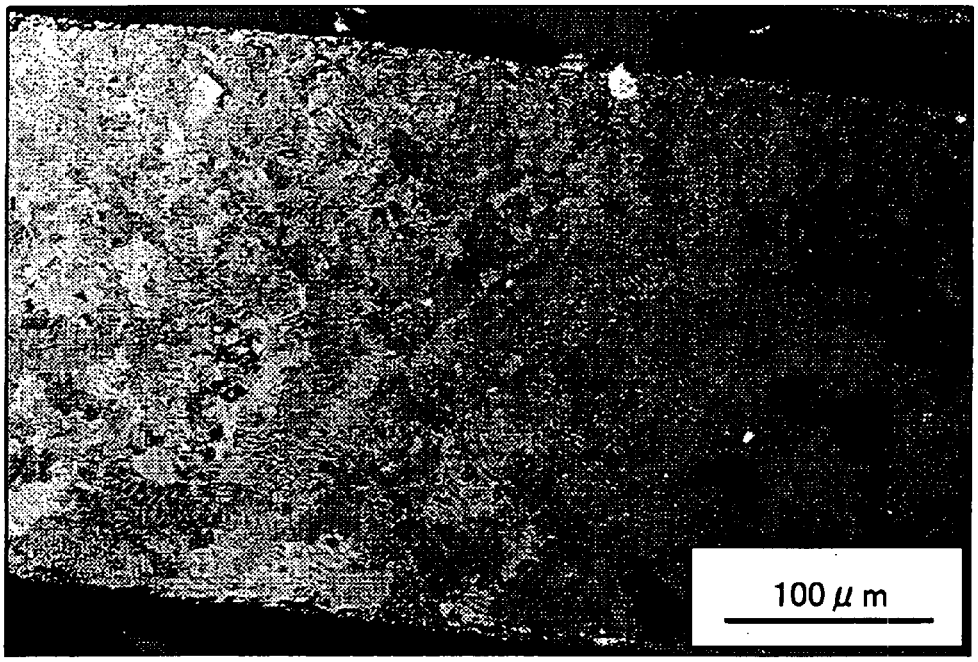
FIG. 1 is a polarizing microscope image of the strip-cast alloy ingot produced in Example 1.

The rare-earth alloy, and specifically $Sm_2Co_{17}$-based permanent magnet alloy, composition according to the first aspect of the invention is composed mainly of 20 to 30 wt % of a rare-earth constituent which is samarium alone or two or more rare-earth elements containing at least 50 wt % samarium, 10 to 45 wt % of iron, 1 to 10 wt % of copper and 0.5 to 5 wt % of zirconium, with the balance being cobalt and inadvertent impurities.

$Sm_2Co_{17}$-based permanent magnet alloy compositions that may be used in the invention include those of the general formula.

$$R(Co_{(1-a-b-c)}Fe_aCu_bZr_c)_z$$

In the above formula, R is samarium alone or at least 50 wt % samarium in combination with at least one other rare-earth element. The letters a, b, c and z are positive numbers which satisfy the conditions $0.1 \leqq a \leqq 0.35$, $0.02 \leqq b \leqq 0.08$, $0.01 \leqq c \leqq 0.05$ and $7.0 \leqq z \leqq 9.0$.

The rare-earth elements other than samarium are not subject to any particular limitation, and preferably include neodymium, cerium, praseodymium and gadolinium. Effective magnetic properties cannot be achieved at a samarium content within the rare-earth constituent of less than 50 wt %, or at a rare-earth element content within the alloy composition of less than 20 wt % or more than 30 wt %.

The $Sm_2Co_{17}$-based permanent magnet alloy of the invention is produced by induction-melting a starting material within the above range in composition in a non-oxidizing atmosphere, setting the resulting alloy melt at a temperature of 1250 to 1600° C., and quenching in a strip casting process. At a melt temperature prior to quenching of less than 1250° C., the quenching temperature range is narrow, resulting in the formation of very large crystals having a grain size of more than 200 μm, and thus a non-uniform composition. Moreover, at a low melt temperature, the viscosity is high, making it difficult to form ingots having a thickness of 3 mm or less. Moreover, the melt solidifies too soon, so that casting cannot be properly carried out. A temperature of at least 1300° C. is preferred. At a temperature above 1600° C., evaporation of the samarium during melting might become excessive, undesirably altering the composition and making it impossible to carry out stable production. A melt temperature of not more than 1500° C. is preferred.

When the thin strip-type ingot thus obtained has a small crystal grain size, the grains grow rapidly during heat treatment; that is, heat treatment causes small grains to be consumed by large grains, which gradually grow even larger. Hence, grain growth proceeds rapidly when the grain size is small. However, if the initial grain size is too small, grain growth varies from place to place within the ingot, resulting in a lack of uniformity in grain size following heat treatment. For this reason, it is preferable for the ingot to have a crystal grain size of 1 to 200 μm, and especially 5 to 100 μm.

"Equiaxed crystal", as used herein, refers to crystals in which the long axis and the short axis have a relatively small difference in length and the orientation of the crystal axes is random, as opposed to columnar crystals which have solidified unidirectionally from the rolled face to the free face of the ingot.

The equiaxed crystals having a grain size of 1 to 200 μm in the alloy system are formed as follows. First, numerous nuclei form as crystal seeds prior to solidification. When heat is taken away from these nuclei at the rolled face of the ingot, they all crystallize, forming equiaxed crystals. Thus, cooling that starts at a temperature directly above the solidification temperature, at which more nuclei are present, is preferred for equiaxed crystal formation. When this is done, the many nuclei crystallize all at once, making it possible to easily achieve a uniform structure. Nor does any segregation occur, as in the case of the large equiaxed crystals having sizes of several hundred microns or more that form in casting by a book molding process. In addition, the equiaxed crystals have an aspect ratio (ratio of long axis to short axis) similar to that of the crystals obtained after heat treatment, allowing heat treatment to be carried out in less time than when the ingot is composed entirely of columnar crystals, for which the difference between the long axis direction and the short axis direction is large. An equiaxed crystal content of at least 20 vol % allows the equiaxed crystals to easily grow larger, and the enlarged grains grow further by taking up small grains, allowing heat treatment to be carried out in a short time. Because the presence of numerous equiaxed crystals which induce such uniform growth in the grain size enables treatment to be carried out in a short time, the equiaxed crystal content is preferably at least 30 vol %, and more preferably at least 40 vol %.

A thin strip-type ingot having too small a thickness undergoes excessive cooling on the roll, resulting in small crystal grains. To achieve a desirable grain size, the ingot must have a thickness of at least 0.05 mm. On the other hand, an ingot that is too thick slows cooling, resulting in a large grain size. Hence, the thickness must not be larger than 3 mm. An ingot thickness within a range of 0.1 to 1 mm is preferred.

When forming the above-described thin film-type ingot, during roll quenching, the roll preferably has a circumferential speed of 0.5 to 10 m/s. The cooling rate may be set within a range of 100 to 10,000° C./s. In a strip casting process, the alloy melt can be cast and quenched on a single roll or twin rolls to form the alloy ingot. The temperature of the alloy melt which is cast onto the roll or rolls is from 1250 to 1600° C.

When the above-described $Sm_2Co_{17}$-based permanent magnet alloy is used to manufacture $Sm_2Co_{17}$-based sintered magnets, first the thin strip-type ingot cast as described above is heat-treated in a non-oxidizing atmosphere such as argon or helium at a temperature of 1000 to 1300° C. for 0.5 to 20 hours, thereby making the average crystal grain size preferably from 20 to 300 μm. The average grain size is more preferably at least 30 μm, even more preferably at least 50 μm, and most preferably at least 100 μm. The upper limit in the average particle size is most preferably 200 μm. At a heat treatment temperature of less than 1000° C., growth of the ingot crystal grains is inadequate. On the other hand, at a temperature above 1300° C., the crystal grains grow well, but because the ingot reaches the melting point, a uniform structure is not achieved. At a heat treatment time of less than 0.5 hour, growth of the crystal grains is variable and does not proceed to a sufficient degree. Heat treatment for longer than 20 hours leads to a deterioration in the ingot on account of leakage from the heat treatment furnace and other undesirable effects, including evaporation of the samarium within the ingot, which tends to prevent good magnetic properties from being achieved. As noted above, at an average crystal grain size of less than 20 μm, the average crystal grain size in the ingot and the particle size of the milled powder in the sintered magnet production process become similar. As a result, the fine powder particles become polycrystalline, disrupting the degree of orientation within the magnet and ultimately leading to a deterioration in the residual flux density and the maximum energy product. On the other hand, at an average crystal grain size greater than 300 μm, heat treatment must be carried out for an extended period of time or at a high temperature, which degrades the alloy structure or compromises its uniformity. These and related effects have an adverse impact on the magnetic properties of the sintered magnet.

As already noted, $Sm_2Co_{17}$-based sintered magnet ingots according to the invention are produced by induction-melting a starting material having the above-indicated range of composition in a non-oxidizing atmosphere, then cooling the melt in a strip casting process. As was explained earlier, regardless of the particular method used in the prior art to cast $Sm_2Co_{17}$-based magnet ingots, the constituent phases have hitherto included 2:17 phase, 1:7 phase, 1:5 phase, 2:7 phase and 1:3 phase, but have under no circumstances contained 50 vol % or more of 1:7 phase. In the present invention, it is advantageous to have the 1:7 phase account for at least 50 vol % of the constituent phases by heat-treating in a non-oxidizing atmosphere an ingot with a microcrystalline structure that has been produced by a strip casting process. The proportion of 1:7 phase within the constituent phases is more preferably at least 65 vol %. At a 1:7 phase content of less than 50 vol %, the desired effects may not be fully achieved.

In connection with the above, the heat treatment temperature is preferably from 1100 to 1250° C., and most preferably from 1100 to 1200° C. Too low a heat treatment temperature may make it difficult to achieve a 1:7 phase content within the ingot of at least 50 vol % and may require a longer period of heat treatment, which can be inefficient. On the other hand, at too high a heat treatment temperature, the ingot approaches the melting point, resulting in the formation within the ingot of other phases, such as 2:17 phase, 1:7 phase, 1:5 phase, 2:7 phase and 1:3 phase, and making it impossible to set the proportion of 1:7 phase within the ingot to at least 50 vol % of the constituent phases. The heat treatment time in this case is preferably from 1 to 20 hours, although too short a heat treatment time tends to result in a variability in the constituent phases. In alloy ingots that do not have a microcrystalline structure, the distance between phases is longer, making the alloy less readily subject to phase transitions during heat treatment. This can make it difficult to set the content of 1:7 phase within the ingot to 50 vol % or more, even when the ingot is heat-treated for a long time or at a high temperature.

The invention can also be practiced using a $Sm_2Co_{17}$-based permanent magnet alloy composition consisting essentially of 20 to 30 wt % of a rare-earth component R which is samarium alone or at least 50 wt % samarium in combination with at least one other rare-earth element, 10 to 45 wt % of iron, 1 to 10 wt % of copper, 0.5 to 5 wt % of zirconium and 0.01 to 1.0 wt % of titanium, with the balance being cobalt and inadvertent impurities. Here too, examples of the rare-earth elements other than samarium that may be used include neodymium, cerium, praseodymium and gadolinium.

When a magnet alloy of the foregoing composition is used, the $Sm_2Co_{17}$-based sintered magnet ingot is produced by induction-melting a starting material within the above range in composition in a non-oxidizing atmosphere, and casting the melt. Casting may be carried out by any suitable process, including casting in a mold, strip casting, gas atomization, and melt spinning. By heat-treating the ingot in a non-oxidizing atmosphere, the alloy can be given a 1:7 phase content which is at least 50 vol % of the constituent phases. The 1:7 phase content is preferably at least 65 vol %. The heat treatment temperature is this case preferably 1100 to 1250° C., and the heat treatment time is preferably 0.5 to 20 hours. The problems encountered with a heat treatment temperature that is too low or too high or with a heat treatment time that is too short or too long might be respectively the same as described above. The foregoing alloy has an average crystal grain size of 20 to 300 $\mu$m, preferably 50 to 300 $\mu$m, and most preferably 100 to 300 $\mu$m. The problems encountered with too small or too large a grain size might be the same as described above.

The above $Sm_2Co_{17}$-based permanent magnet alloy is crushed, then milled to an average particle size of 1 to 10 $\mu$m, and preferably about 5 $\mu$m. Crushing is typically carried out in an inert gas atmosphere by means of, for example, a jaw crusher, a Brown mill, a pin mill or hydrogen occlusion. Milling is typically carried out in a wet ball mill using a suitable solvent such as an alcohol or hexane, in a dry ball mill under an inert gas atmosphere such as nitrogen or argon, or in a jet mill using a stream of inert gas.

The resulting milled powder is compression-molded using a press or other suitable means within a magnetic field of preferably at least 10 kOe, and under a pressure of preferably at least 500 kg/cm$^2$ but less than 2000 kg/cm$^2$. The resulting powder compact is sintered and solution treated with a heat treatment furnace in a non-oxidizing atmosphere such as argon at a temperature 1100 to 1300° C., and preferably 1150 to 1250° C., for a period of 0.5 to 5 hours. Following completion of these steps, the sintered, solution-treated compact is quenched. The compact is then subjected to aging treatment in which it is held at a temperature of 700 to 900° C., and preferably 750 to 850° C., for 5 to 40 hours, then gradually cooled down to 400° C. at a rate of −1.0° C., thereby yielding a $Sm_2Co_{17}$-based sintered magnet according to the invention.

EXAMPLES

The following examples and comparative examples are provided to illustrate the invention, and are not intended to limit the scope thereof.

Example 1

A $Sm_2Co_{17}$-based magnet ingot was produced by formulating a starting material composed of 25.5 wt % samarium, 16.0 wt % iron, 5.0 wt % copper and 3.0 wt % zirconium, with the balance being cobalt. The composition was placed in an alumina crucible and melted in an induction furnace under an argon gas atmosphere, following which the melt was strip-cast using a single water-cooled roll (circumferential speed of roll, 1 m/s) at a melt temperature of 1350° C. FIG. 1 is a polarizing microscope image of the microstructure in the resulting alloy. The alloy had a plate thickness of 0.3 mm and an average crystal grain size of 10 $\mu$m. Equiaxed crystals having a grain size of 1 to 200 $\mu$m accounted for 95 vol % of the crystals, with the remainder being columnar crystals. "Average crystal grain size", as used here and below, refers to the average size of the crystal grains expressed as the diameter of a sphere of the same volume.

The $Sm_2Co_{17}$-based magnet ingot was then heat-treated in a heat treatment furnace under an argon atmosphere at 1200°C. for 1 hour. Following the completion of heat treatment, the ingot was quenched. The amount of samarium in the resulting $Sm_2Co_{17}$-based magnet alloy was quantitatively determined by an ion exchange separation technique. In addition, the average crystal grain size was measured.

The heat-treated $Sm_2Co_{17}$-based magnet alloy was crushed to a size of about 500 $\mu$m or less with a jaw crusher, then milled to an average particle size of about 5 $\mu$m with a jet mill using a stream of nitrogen gas. Next, the milled alloy was molded in a press under a pressure of 1.5 metric tons/cm$^2$ while being subjected to a magnetic field of 15 kOe. The resulting powder compacts were sintered in a heat treatment furnace under an argon atmosphere at 1210° C. for 2 hours, after which 1 hour of solution treatment was carried out in argon at 1190° C. Following the completion of solution treatment, the sintered compacts were quenched, then each was held in an argon atmosphere at 800° C. for 10 hours and gradually cooled to 400° C. at a rate of −1.0° C./min, thereby giving sintered magnets. The magnetic properties of each of the resulting sintered magnets were measured with a BH tracer.

Comparative Example 1

Figure 2:
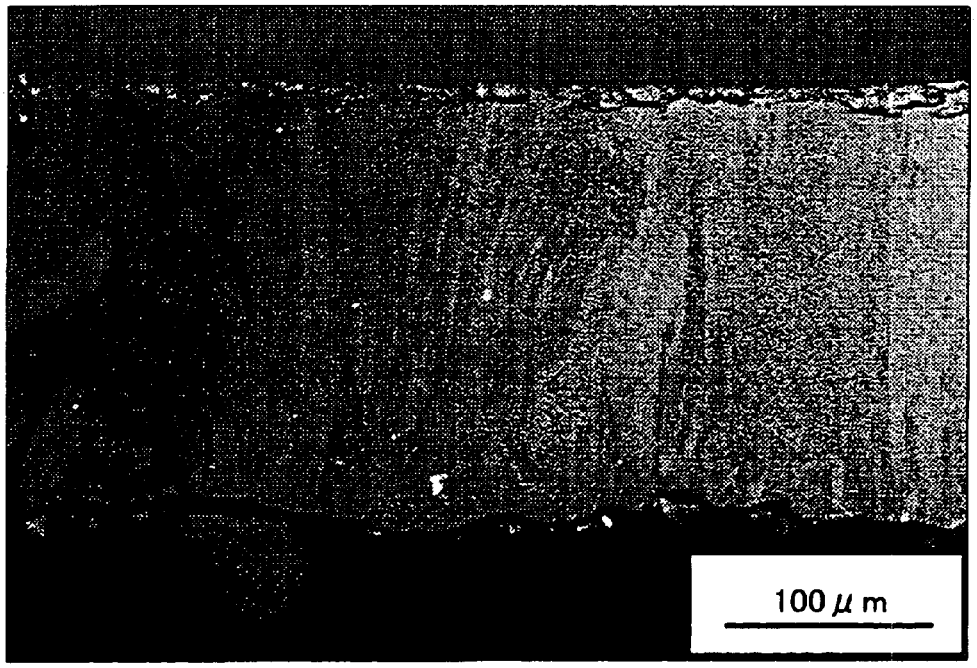
FIG. 2 is a polarizing microscope image of the strip-cast alloy ingot produced in Comparative Example 1.

An alloy having the same composition as in Example 1 was placed in an alumina crucible and melted in an induction furnace under an argon atmosphere, following which the melt was strip-cast using a single water-cooled roll (circumferential speed of roll, 1 m/s) at a melt temperature of 1650° C. FIG. 2 is a polarizing microscope image of the microstructure in the resulting alloy. The alloy had a plate thickness of 0.3 mm and an average crystal grain size of 20 μm. Equiaxed crystals having a grain size of 1 to 200 μm accounted for 5 vol % of the crystals, with the remainder being columnar crystals.

The $Sm_2Co_{17}$-based magnet alloy was then heat-treated in the same way as in Example 1. The amount of samarium in the resulting $Sm_2Co_{17}$-based magnet alloy was quantitatively determined by an ion exchange separation technique. In addition, the average crystal grain size was measured.

The heat-treated $Sm_2Co_{17}$-based magnet alloy was then subjected to crushing, milling, molding in a magnetic field, sintering, solution treatment, and aging treatment by the same methods as described above in Example 1, thereby producing sintered magnets. The magnetic properties of the resulting sintered magnets were measured in the same way as in Example 1.

Table 1 below shows the samarium contents and the average crystal grain sizes for the $Sm_2Co_{17}$-based magnet alloys obtained in Example 1 and Comparative Example 1, as well as the magnetic properties of sintered magnets obtained from each of the alloys. It is apparent from these results that the sintered magnets produced in Example 1 had a better residual flux density (Br), coercivity (HcJ) and maximum energy product ($(BH)_{max}$) than the sintered magnets produced in Comparative Example 1.

TABLE 1

| | Br (kG) | HcJ (kOe) | $(BH)_{max}$ (MGOe) | Samarium content (wt %) | Average crystal grain size (μm) |
|---|---|---|---|---|---|
| Example 1 | 11.0 | 14.0 | 28.2 | 25.3 | 50 |
| Comparative Example 1 | 10.3 | 9.2 | 23.5 | 24.8 | 30 |

Example 2

A $Sm_2Co_{17}$-based magnet ingot was produced by formulating a starting material composed of 20.0 wt % samarium, 5.5 wt % cerium, 14.0 wt % iron, 5.0 wt % copper and 3.0 wt % zirconium, with the balance being cobalt. The composition was placed in an alumina crucible and melted in an induction furnace under an argon gas atmosphere, following which the melt was strip-cast using a single water-cooled roll (circumferential speed of roll, 2.5 m/s) at a melt temperature of 1400° C. The alloy had a plate thickness of 0.2 mm and an average crystal grain size of 30 μm. Equiaxed crystals having a grain size of 1 to 200 μm accounted for 80 vol % of the crystals, with the remainder being columnar crystals.

Figure 3:
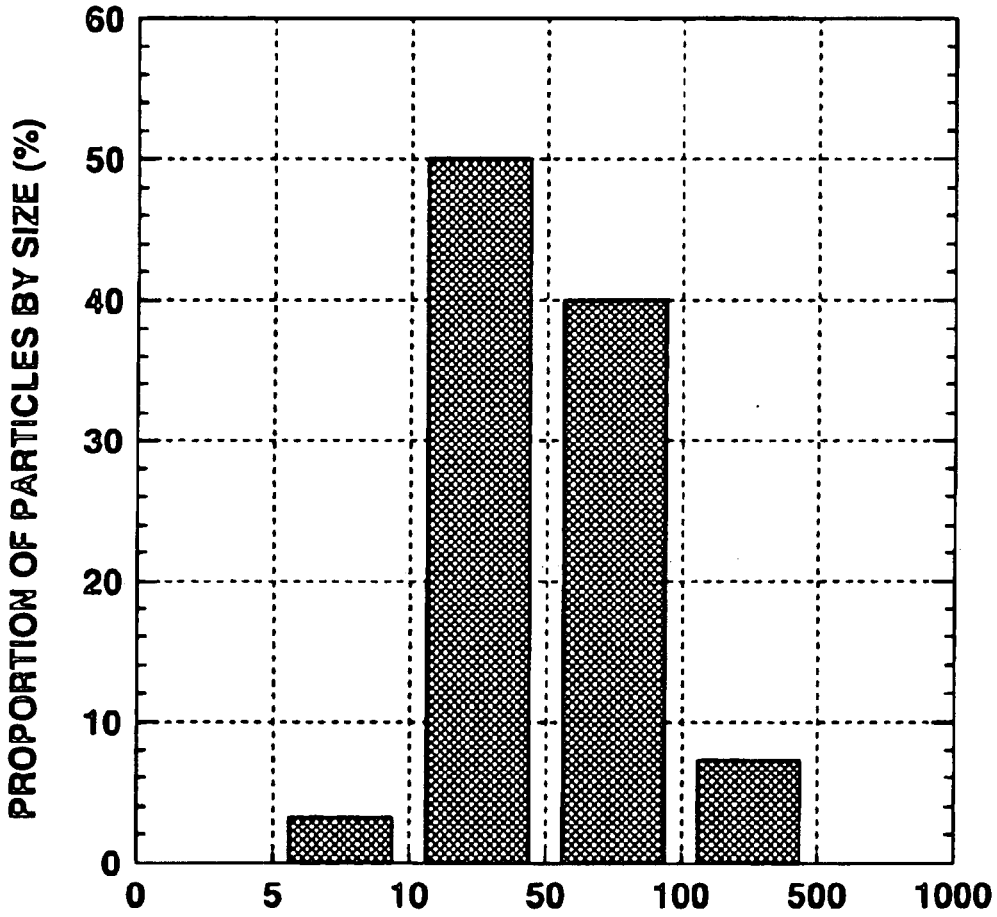
FIG. 3 is a graph of the particle size distribution following heat treatment of the strip-cast alloy ingot produced in Example 2.

The $Sm_2Co_{17}$-based magnet ingot was then heat-treated in a heat treatment furnace under an argon atmosphere at 1100° C for 2 hours. Following the completion of heat treatment, the ingot was quenched. The size of the crystal grains in the resulting $Sm_2Co_{17}$-based magnet alloy was measured, and the distribution in grain size determined. The results are shown in FIG. 3.

The heat-treated $Sm_2Co_{17}$-based magnet alloy was crushed to a size of about 500 μm or less with a jaw crusher, then milled to an average particle size of about 5 μm with a jet mill using a stream of nitrogen gas. Next, the milled alloy was molded in a press under a pressure of 1.5 t/cm$^2$ while being subjected to a magnetic field of 15 kOe. The resulting powder compacts were sintered in a heat treatment furnace under an argon atmosphere at 1190° C. for 2 hours, after which 1 hour of solution treatment was carried out in argon at 1170° C. Following the completion of solution treatment, the sintered compacts were quenched, then each was held in an argon atmosphere at 800° C. for 10 hours and gradually cooled to 400° C. at a rate of −1.0° C./min, thereby giving sintered magnets. The magnetic properties of each of the resulting sintered magnets were measured with a BH tracer.

Comparative Example 2

An alloy having the same composition as in Example 2 was placed in an alumina crucible and melted in an induction furnace under an argon atmosphere, following which the melt was strip-cast using a single water-cooled roll (circumferential speed of roll, 50 m/s) at a melt temperature of 1240° C. The alloy had a plate thickness of 0.1 mm and an average crystal grain size of 0.5 μm. Equiaxed crystals having a grain size of 1 to 200 μm accounted for 5 vol % of the crystals, equiaxed crystals with a grain size of less than 1 μm accounted for 90 vol %, and the remainder of the crystals were columnar.

Figure 4:
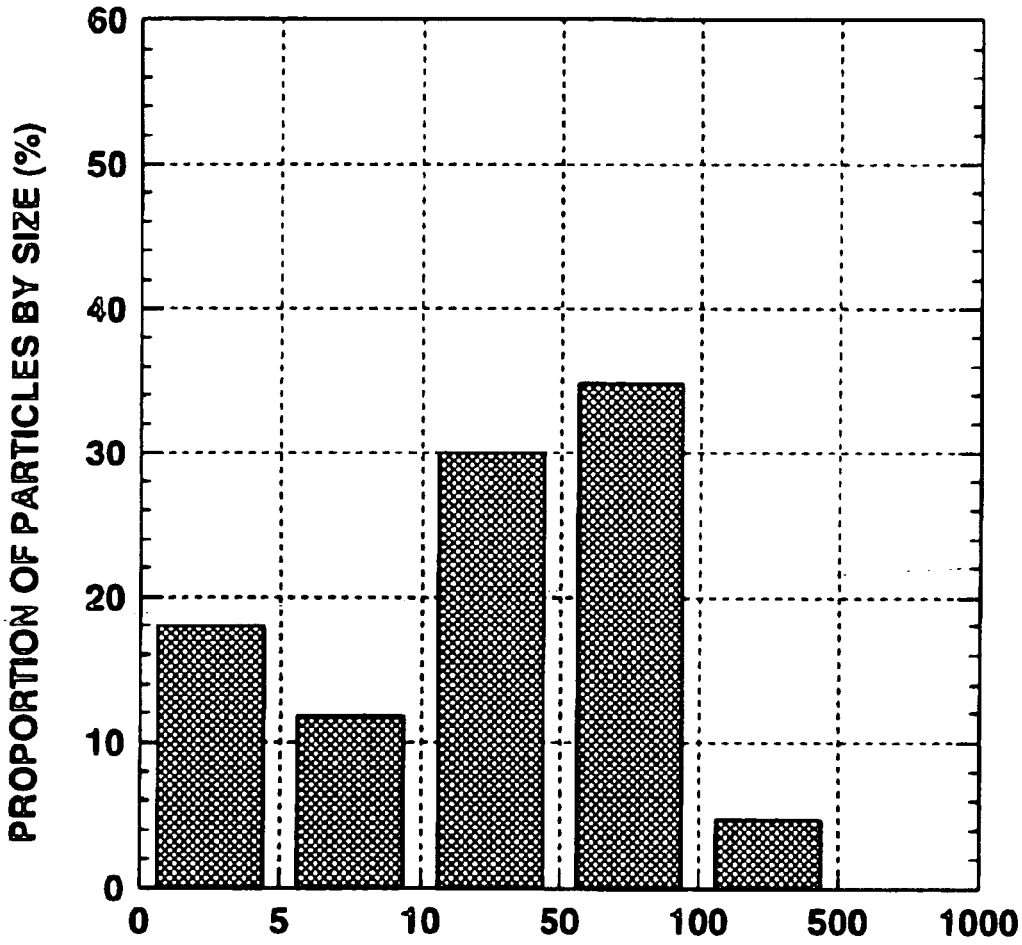
FIG. 4 is a graph of the particle size distribution following heat treatment of the strip-cast alloy ingot produced in Comparative Example 2.

The resulting $Sm_2Co_{17}$-based magnet alloy was heat-treated in the same way as in Example 2. The size of the crystal grains in the heat-treated $Sm_2Co_{17}$-based magnet alloy was then measured, and the distribution in grain size determined. The results are shown in FIG. 4.

The heat-treated $Sm_2Co_{17}$-based magnet alloy was then subjected to crushing, milling, molding in a magnetic field, sintering, solution treatment, and aging treatment by the same methods as in Example 2 above, thereby producing sintered magnets. The magnetic properties of the resulting sintered magnets were measured in the same way as in Example 2.

Comparative Example 3

Figure 5:
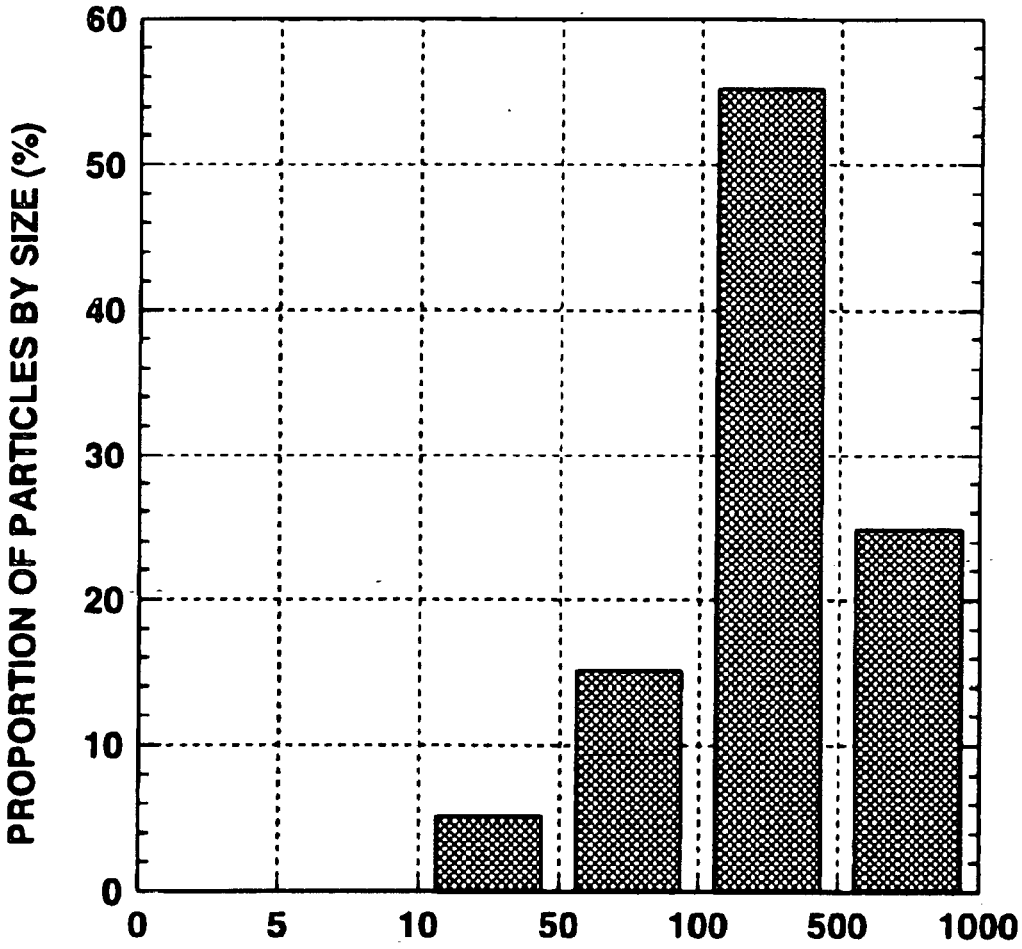
FIG. 5 is a graph of the particle size distribution following heat treatment of the strip-cast alloy ingot produced in Comparative Example 3.
Figure 6:
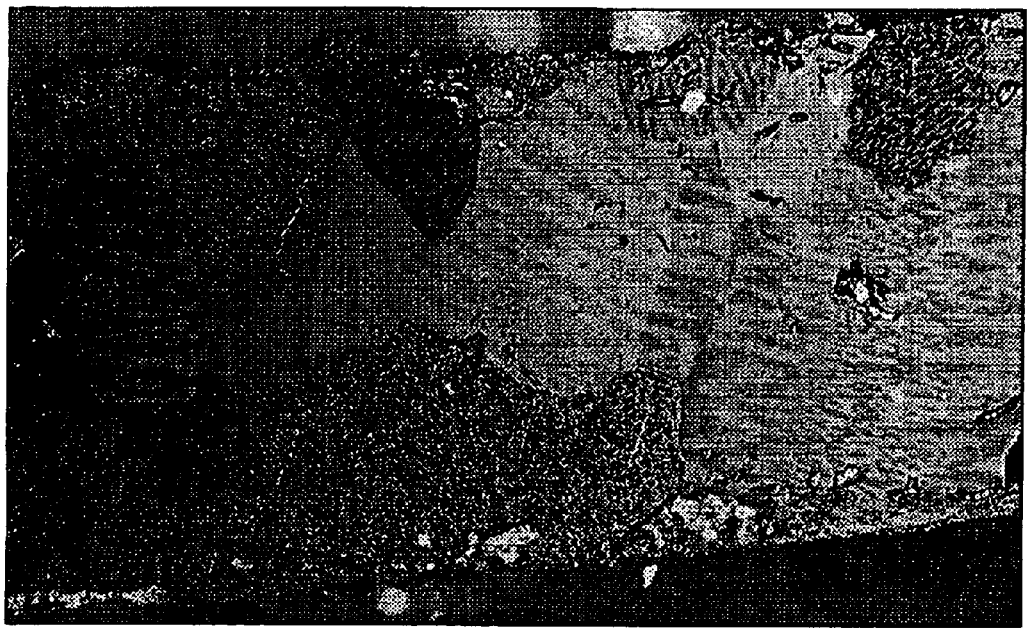
FIG. 6 is a polarizing microscope image of the magnet material produced in Example 3.
Figure 7:
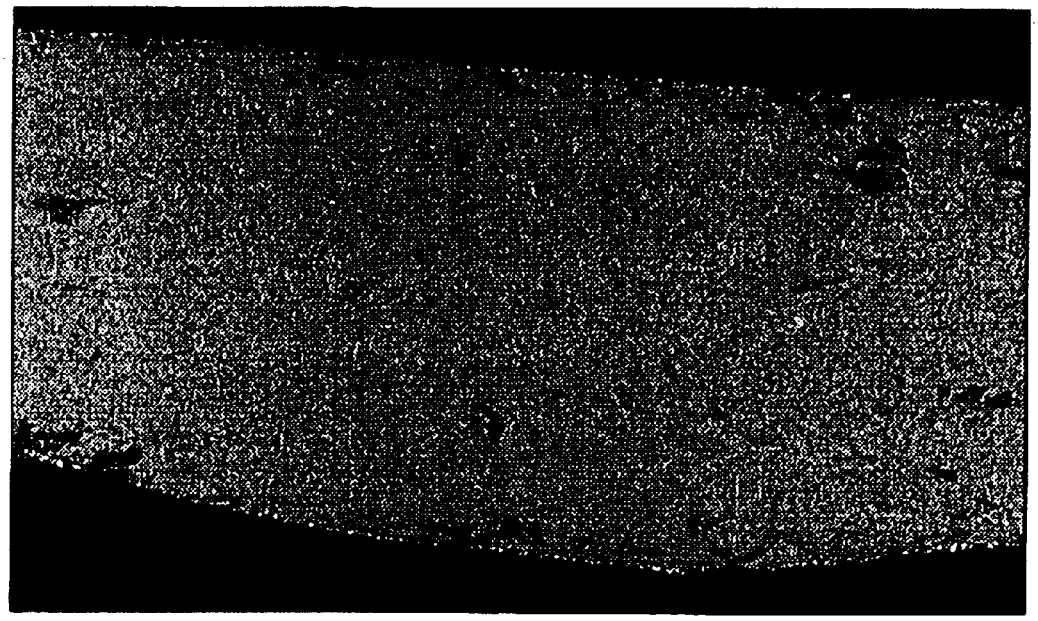
FIG. 7 is a reflected electron image taken under a scanning electron microscope of the magnet material produced in Example 3.
Figure 8:
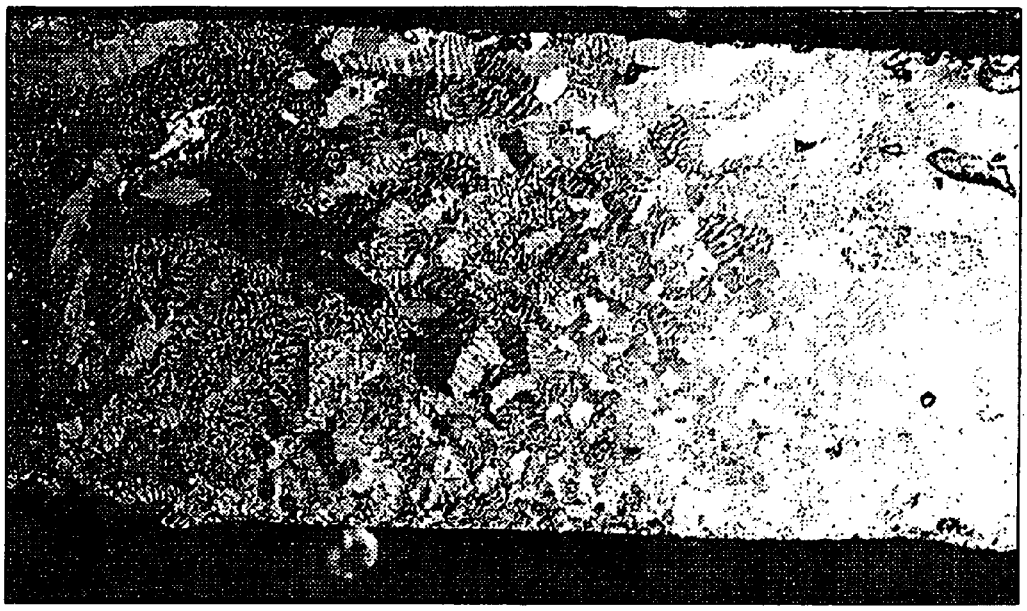
FIG. 8 is a polarizing microscope image of the magnet material produced in Example 4.
Figure 9:
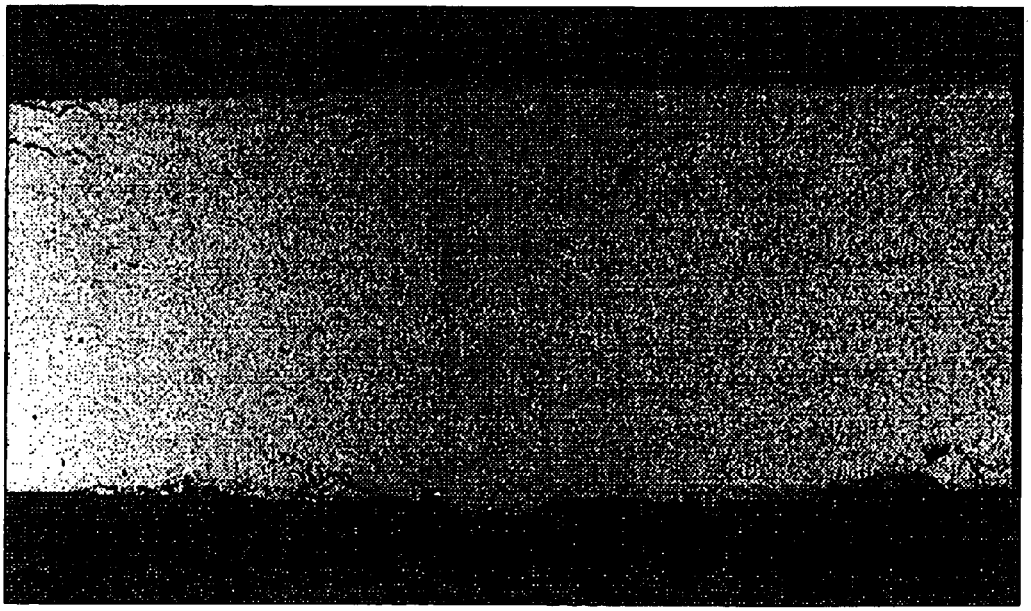
FIG. 9 is a reflected electron image taken under a scanning electron microscope of the magnet material produced in Example 4.
Figure 10:
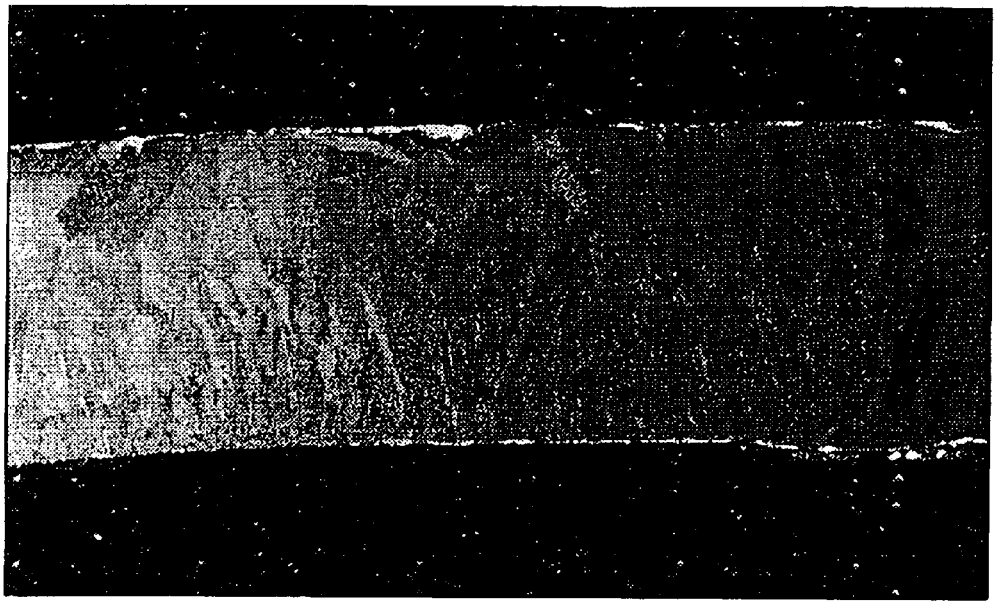
FIG. 10 is a polarizing microscope image of the magnet material produced in Comparative Example 4.
Figure 11:
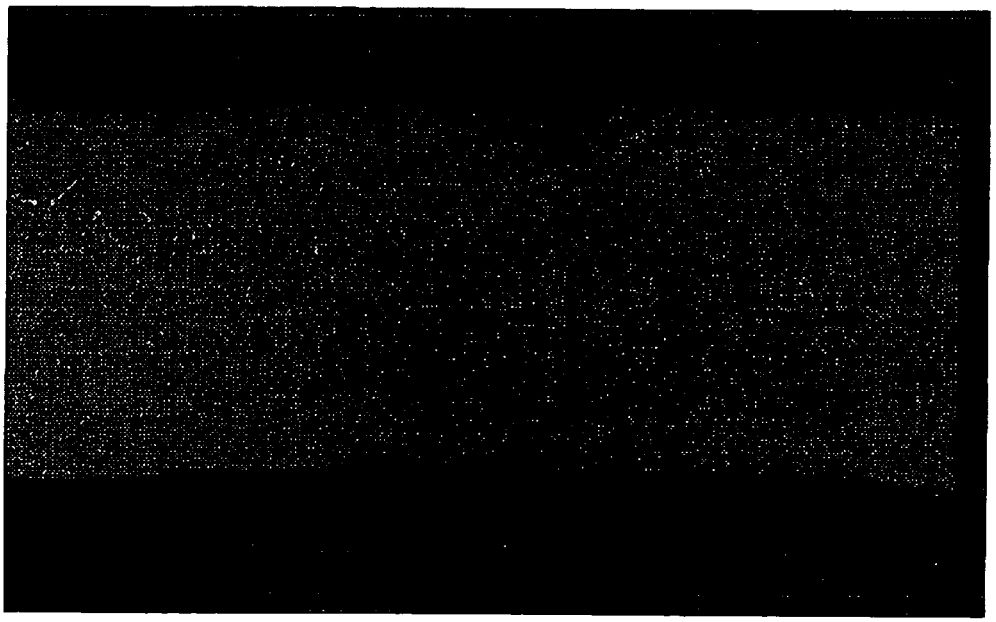
FIG. 11 is a reflected electron image taken under a scanning electron microscope of the magnet material produced in Comparative Example 4.
Figure 12:
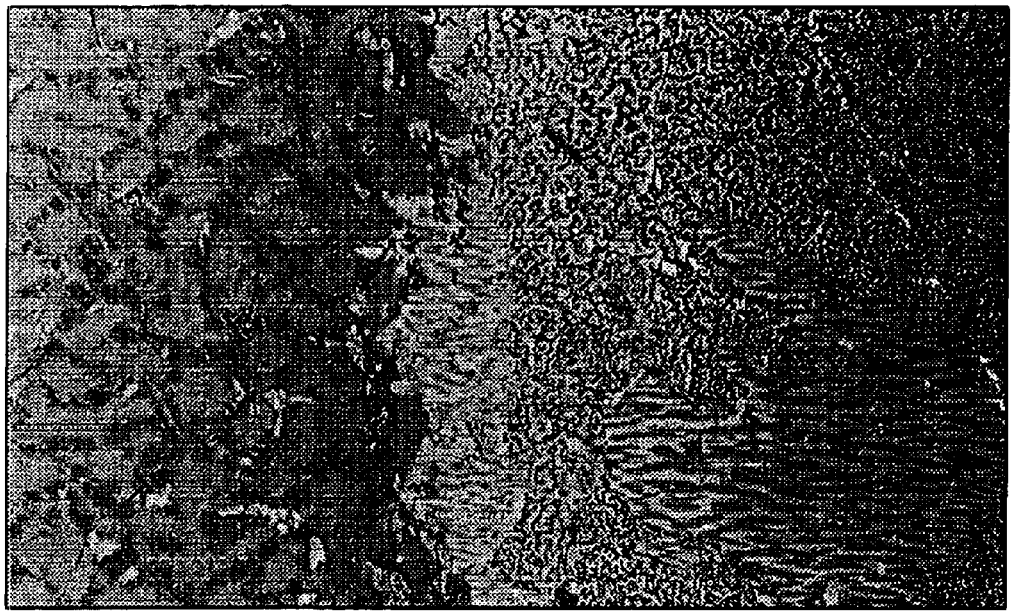
FIG. 12 is a polarizing microscope image of the magnet material produced in Comparative Example 5.
Figure 13:
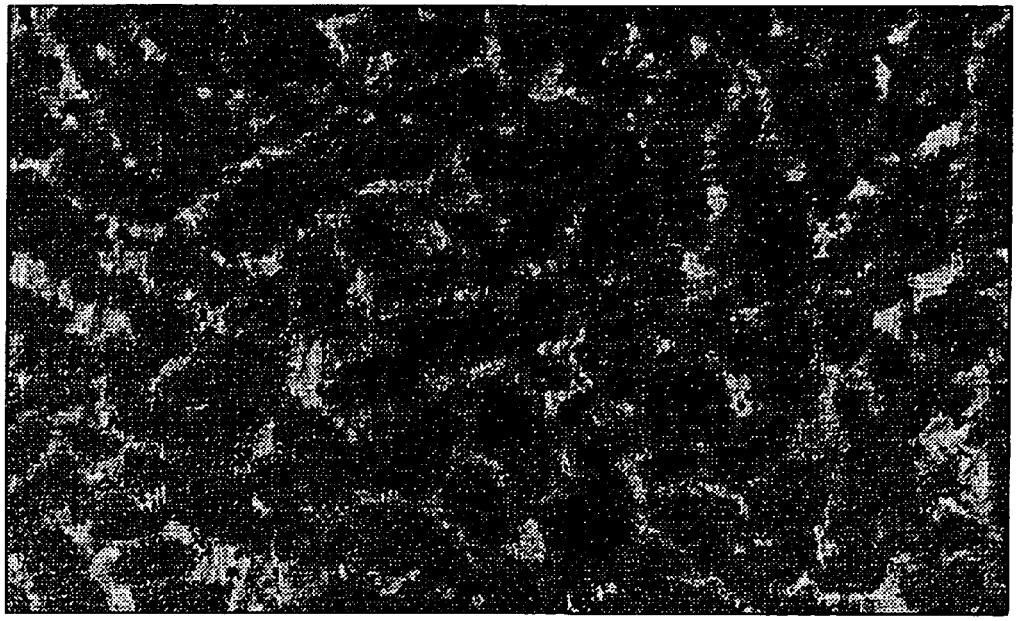
FIG. 13 is a reflected electron image taken under a scanning electron microscope of the magnet material produced in Comparative Example 5.

An alloy having the same composition as in Example 2 was placed in an alumina crucible and melted in an induction furnace under an argon atmosphere, following which the melt was cast in a copper mold so as to form a $Sm_2Co_{17}$-based magnet alloy ingot having a thickness of 15 mm. The size of the crystal grains in the resulting $Sm_2Co_{17}$-based magnet alloy was measured as in Example 2, and the distribution in grain size determined. The results are shown in FIG. 5.

The heat-treated $Sm_2Co_{17}$-based magnet alloy was then subjected to crushing, milling, molding in a magnetic field, sintering, solution treatment, and aging treatment by the same methods as in Example 2 above, thereby producing sintered magnets. The magnetic properties of the resulting sintered magnets were measured in the same way as in Example 2.

Table 2 below shows the magnetic properties of the $Sm_2Co_{17}$-based magnet alloys obtained in Example 2 and Comparative Examples 2 and 3. From FIGS. 3 to 5, it is apparent that the alloy produced in Example 2 had a uniform grain size distribution close to 50 μm, whereas the alloy produced in Comparative Example 2 had a broader grain size distribution characterized by the presence of many small particles, and the alloy produced in Comparative Example 3 had a very large grain size. These differences were reflected in the residual flux densities, coercivities and maximum energy products which, as shown in Table 2, were better in Example 2 than in Comparative Examples 2 and 3.

TABLE 2

| | Br (kG) | HcJ (kOe) | $(BH)_{max}$ (MGOe) |
|---|---|---|---|
| Example 2 | 10.6 | 15 | 26.4 |
| Comparative Example 2 | 10.2 | 16.1 | 23.8 |
| Comparative Example 3 | 10.3 | 14.5 | 24.1 |

Examples 3 and 4

In each example, a $Sm_2Co_{17}$-based magnet ingot was produced by formulating a starting material composed of 25.5 wt % samarium, 14.0 wt % iron, 4.5 wt % copper and 2.8 wt % zirconium, with the balance being cobalt. The composition was placed in an alumina crucible and melted in an induction furnace under an argon gas atmosphere, following which the melt was strip-cast using a single water-cooled roll (circumferential speed of roll, 1 m/s) at a cooling rate of −2000° C/s. The resulting $Sm_2Co_{17}$-based magnet ingot was heat-treated in a heat treatment furnace under an argon atmosphere at 1200° C. for 2 hours. Following the completion of heat treatment, the ingot was quenched. The structures of the resulting $Sm_2Co_{17}$-based magnet alloys were examined under a polarizing microscope and a scanning electron microscope, in addition to which the average crystal grain sizes were measured.

The $Sm_2Co_{17}$-based magnet alloys were crushed to a size of about 500 μm or less with a jaw crusher and Brown mill, then milled to an average particle size of about 5 μm with a jet mill using a stream of nitrogen gas. Next, the milled alloys were molded in a press under a pressure of 1.5 t/cm$^2$ while being subjected to a magnetic field of 15 kOe. The resulting powder compacts were sintered in a heat treatment furnace at 1220° C. for 2 hours under an argon atmosphere, after which 1 hour of solution treatment was carried out in argon at 1200° C. Following the completion of solution treatment, the sintered compacts were quenched, then each was held in an argon atmosphere at 800° C. for 10 hours and gradually cooled to 400° C. at a rate of −1.0° C./min, thereby giving sintered magnets. The magnetic properties of the resulting sintered magnets were measured with a BH tracer.

Comparative Example 4

An alloy of the same composition as in Example 3 was produced by the same casting method as in Example 3. However, heat treatment was not carried out after casting. The structure of the resulting $Sm_2Co_{17}$-based magnet alloy was examined and the average grain size measured as in Example 3.

The resulting $Sm_2Co_{17}$-based magnet alloy was then subjected to crushing, milling, molding in a magnetic field, sintering, solution treatment, and aging treatment by the same methods as described above in Example 3, thereby producing a sintered magnet. The magnetic properties of the resulting sintered magnet were measured in the same way as in Example 3.

Comparative Example 5

Starting materials of the same composition as in Example 3 were placed in an alumina crucible and melted in an induction furnace under an argon atmosphere, then cast in a copper box-like mold so as to give a $Sm_2Co_{17}$-based magnet alloy having a thickness of 15 mm. The structure of the resulting $Sm_2Co_{17}$-based magnet alloy was examined and the average crystal grain size measured as in Example 3

The resulting $Sm_2Co_{17}$-based magnet alloy was then subjected to crushing, milling, molding in a magnetic field, sintering, solution treatment, and aging treatment by the same methods as described above in Example 3, thereby producing a sintered magnet. The magnetic properties of the resulting sintered magnet were measured in the same way as in Example 3.

Table 3 below shows the heat treatment conditions of the $Sm_2Co_7$-based magnet alloys obtained in Examples 3 and 4 and Comparative Examples 4 and 5. The average crystal grain size of the magnet alloys and the magnetic properties of sintered magnets produced from the magnet alloys are also shown. It is apparent from these results that the sintered magnets obtained in Examples 3 and 4 had better residual flux densities and maximum energy products than the magnets obtained in Comparative Examples 4 and 5.

TABLE 3

| | Heat treatment method | Br (kG) | HcJ (kOe) | $(BH)_{max}$ (MGOe) | Average crystal grain size (μm) |
|---|---|---|---|---|---|
| Example 3 | 1200° C., 2 hours | 10.8 | 15.0 | 27.7 | 150 |
| Example 4 | 1100° C., 2 hours | 10.7 | 15.5 | 27.1 | 20 |
| Comparative Example 4 | — | 9.8 | 19.4 | 21.9 | 10 |
| Comparative Example 5 | — | 10.4 | 14.8 | 24.8 | 300 |

Examples 5 to 7

In each example, a $Sm_2Co_{17}$-based magnet ingot was produced by formulating a starting material composed of 25.5 wt % samarium, 19.0 wt % iron, 4.0 wt % copper and 2.5 wt % zirconium, with the balance being cobalt. The composition was placed in an alumina crucible and melted in an induction furnace under an argon gas atmosphere, following which the melt was strip-cast using a single water-cooled roll (circumferential speed of roll, 1 m/s; cooling rate, −2000° C./s). The resulting samarium-cobalt-based magnet ingot was heat-treated in a heat treatment furnace under an argon atmosphere at 1150° C. for 2 hours. Following the completion of heat treatment, the ingot was quenched. The constituent phases of the resulting $Sm_2Co_{17}$-based magnet alloys were identified by x-ray diffraction analysis (using Cu Kα radiation), and the proportion of 1:7 phase among the constituent phases was measured. The proportion of 1:7 phase was determined by comparing the peak intensity for $Th_2Zn_{17}$-type crystal structures with the peak intensity for $TbCu_7$-type crystal structures in the respective x-ray diffraction pattern.

The $Sm_2Co_{17}$-based magnet alloys were crushed to a size of about 500 μm or less with a jaw crusher and Brown mill, then milled to an average particle size of about 5 μm with a jet mill using a stream of nitrogen gas. Next, the milled alloys were molded in a press under a pressure of 1.5 t/cm$^2$ while being subjected to a magnetic field of 15 kOe. The resulting powder compacts were sintered in a heat treatment furnace at 1180° C. (Example 5), 1175° C. (Example 6) and 1185° C. (Example 7) for 2 hours under an argon atmosphere, after which 1 hour of solution treatment was carried out in argon at 1150° C. Following the completion of solution treatment, the sintered compacts were quenched, then each was held in an argon atmosphere at 800° C. for 10 hours and gradually cooled to 400° C. at a rate of −1.0° C./min, thereby giving sintered magnets. The magnetic properties of the resulting sintered magnets were measured with a BH tracer.

Comparative Example 6

An alloy of the same composition as in Example 5 was manufactured by the same casting method as in Example 5. However, heat treatment was not carried out after casting. The constituent phases of the resulting $Sm_2Co_{17}$-based magnet alloy were identified by x-ray diffraction analysis (Cu Kα), and the proportion of 1:7 phase was measured as in Example 5.

The resulting $Sm_2Co_{17}$-based magnet alloy was then subjected to crushing, milling, molding in a magnetic field, sintering, solution treatment, and aging treatment by the same methods as described above in Example 5, thereby producing a sintered magnet. The magnetic properties of the resulting sintered magnet were measured in the same way as in Example 5.

Comparative Examples 7 to 9

Starting materials of the same composition as in Example 5 were placed in an alumina crucible and melted in an induction furnace under an argon atmosphere, then cast in a copper box-like mold so as to give $Sm_2Co_7$-based magnet alloys having a thickness of 15 mm. The constituent phases of the resulting $Sm_2Co_7$-based magnet alloys were identified by x-ray diffraction analysis (Cu Kα), and the proportion of 1:7 phase was measured as in Example 5.

The resulting $Sm_2Co_{17}$-based magnet alloys were then subjected to crushing, milling, molding in a magnetic field, sintering, solution treatment, and aging treatment by the same methods as described above in Examples 5 to 7, thereby producing sintered magnets. The magnetic properties of the resulting sintered magnets were measured in the same way as in Examples 5 to 7.

Figure 14:
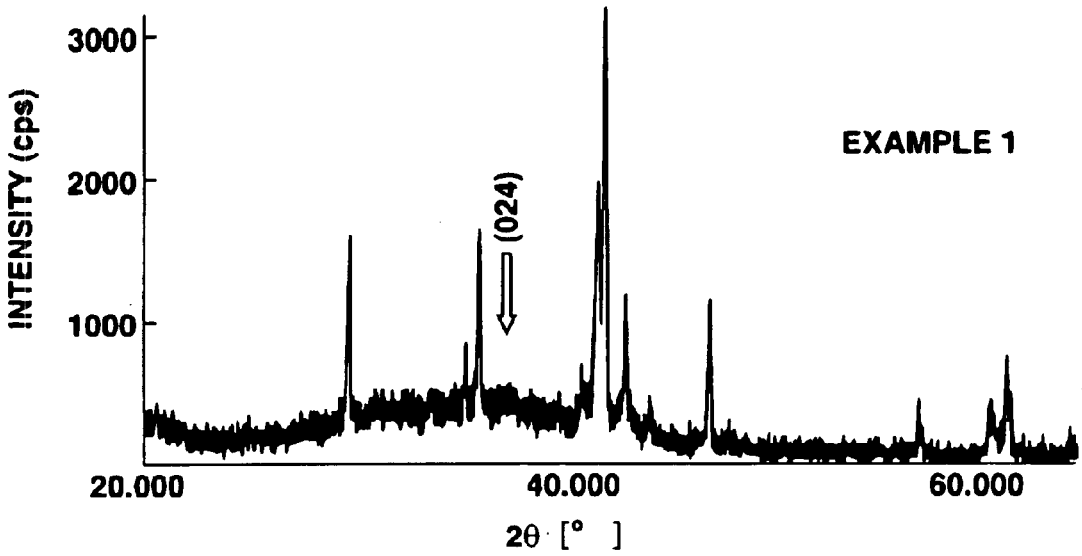
FIG. 14 is an x-ray diffraction pattern for the $Sm_2Co_{17}$-based magnet alloy produced in Example 5.
Figure 15:
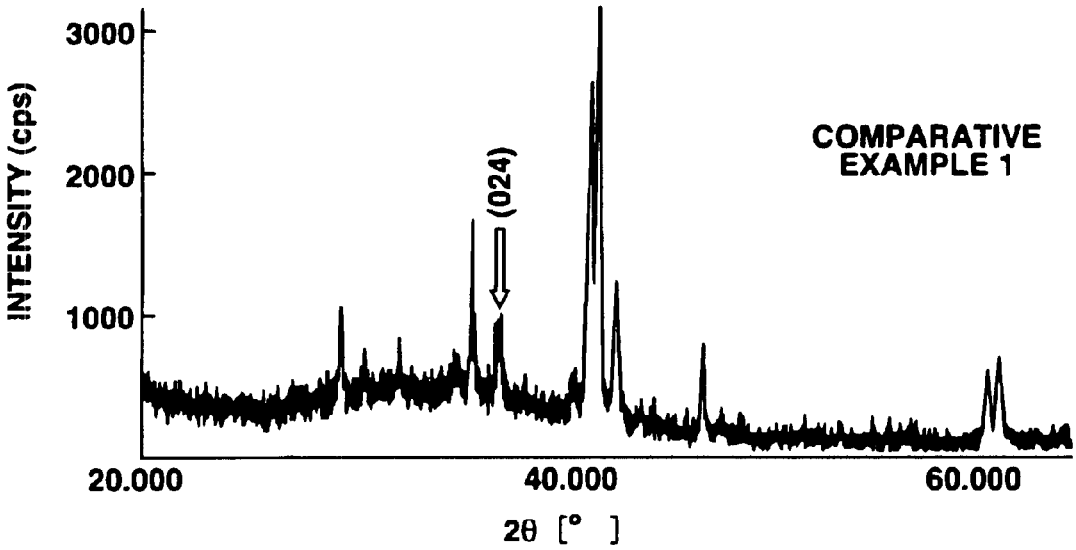
FIG. 15 is an x-ray diffraction pattern for the $Sm_2Co_{17}$-based magnet alloy produced in Comparative Example 6.
Figure 16:
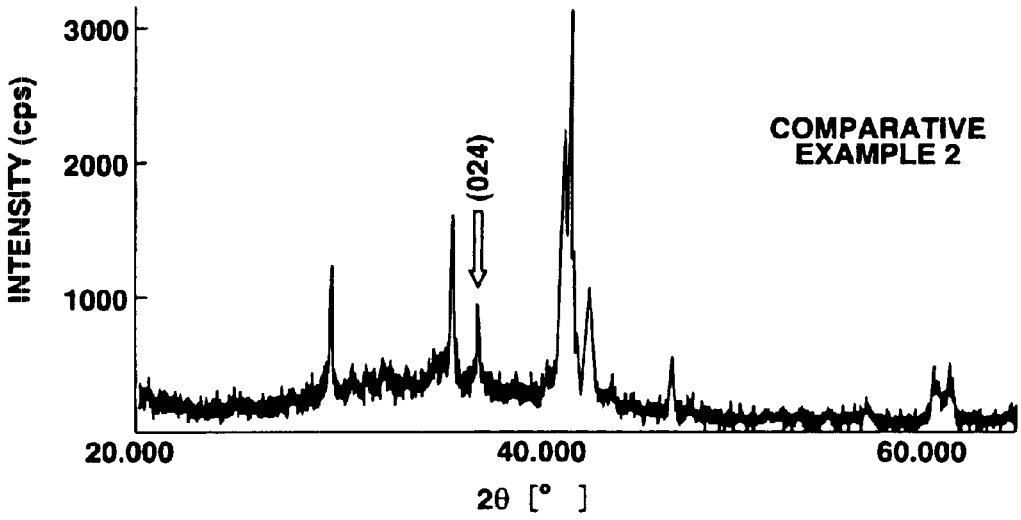
FIG. 16 is an x-ray diffraction pattern for the $Sm_2Co_{17}$-based magnet alloy produced in Comparative Example 7.

Table 4 below shows the magnetic properties of the sintered magnets obtained in Example 5 and Comparative Examples 6 and 7, as well as the proportion of 1:7 phase within the respective $Sm_2Co_{17}$-based magnet alloys. It is apparent from these results that the sintered magnet obtained in Example 5 having a high proportion of 1:7 phase in the magnet alloy exhibits a better residual flux density and maximum energy product than the sintered magnets obtained in the comparative examples. FIGS. 14 to 16 show the x-ray diffraction patterns for these three examples.

TABLE 4

| | Heat treatment method | Br (kG) | HcJ (kOe) | $(BH)_{max}$ (MGOe) | Phase 1:7 content (μm) |
|---|---|---|---|---|---|
| Example 5 | 1150° C., 2 hours | 11.6 | 14.3 | 31.1 | 70 |
| Comparative | — | 10.7 | 19.4 | 24.9 | 35 |

TABLE 4-continued

| | Heat treatment method | Br (kG) | HcJ (kOe) | $(BH)_{max}$ (MGOe) | Phase 1:7 content (μm) |
|---|---|---|---|---|---|
| Example 6 | | | | | |
| Comparative Example 7 | — | 11.2 | 14.5 | 27.6 | 35 |

Figure 17:
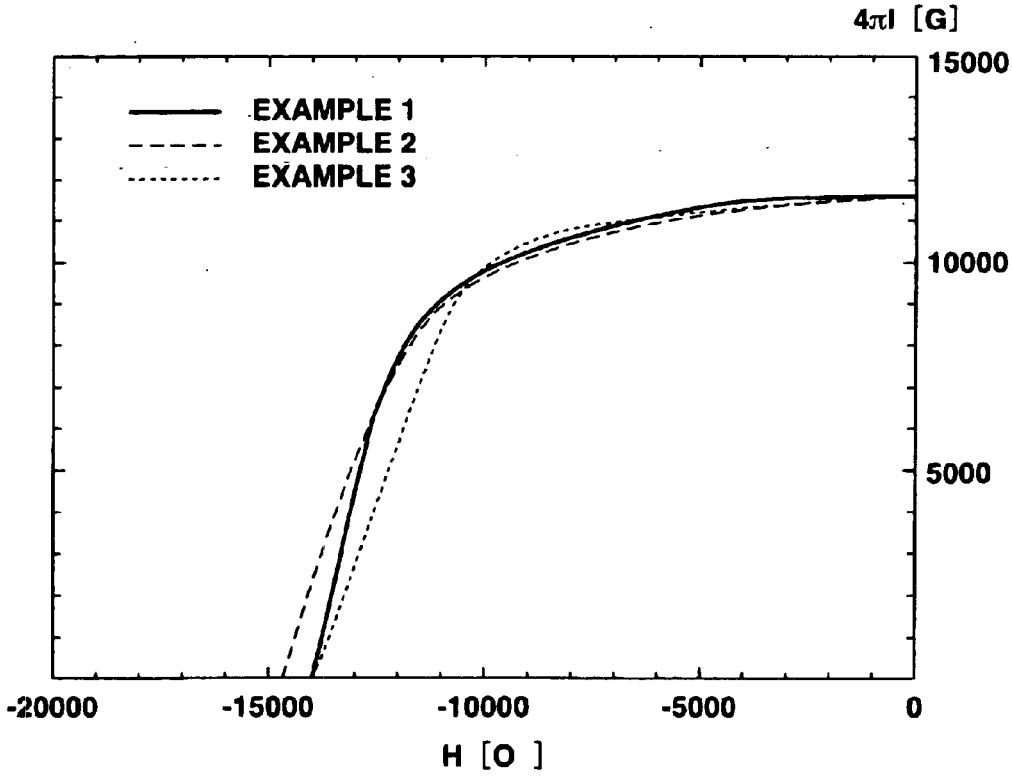
FIG. 17 shows the demagnetization curves for sintered magnets produced in Examples 5 to 7.
Figure 18:
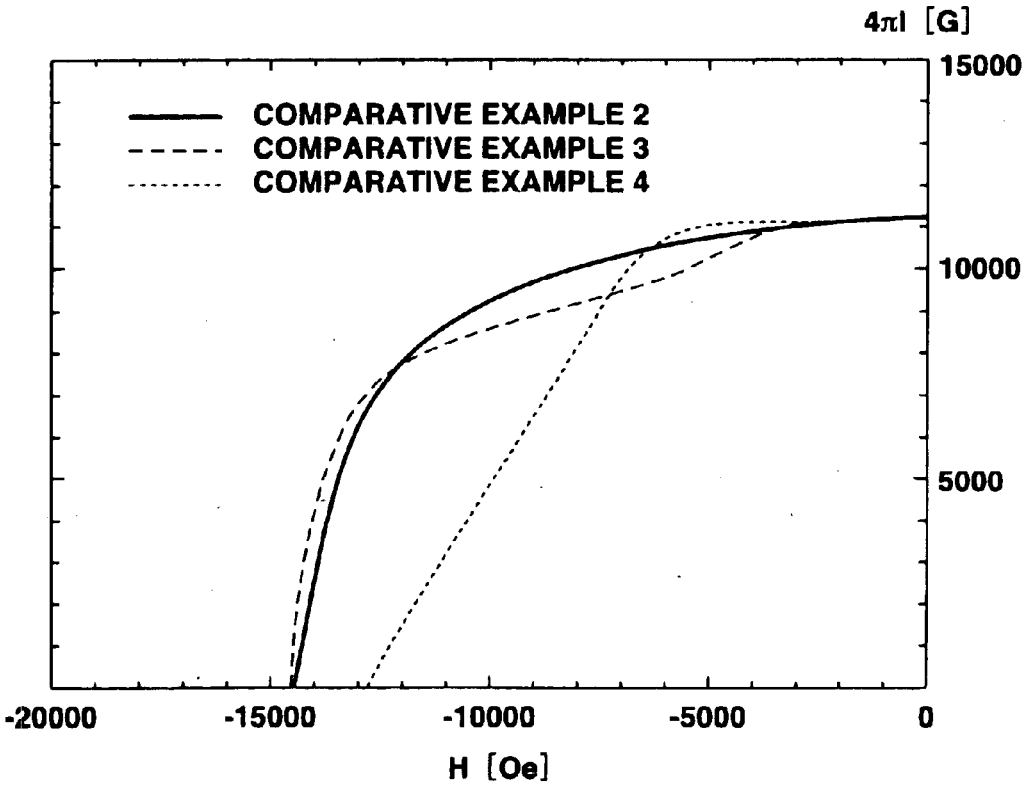
FIG. 18 shows the demagnetization curves for sintered magnets produced in Comparative Examples 7 to 9.
Figure 19:
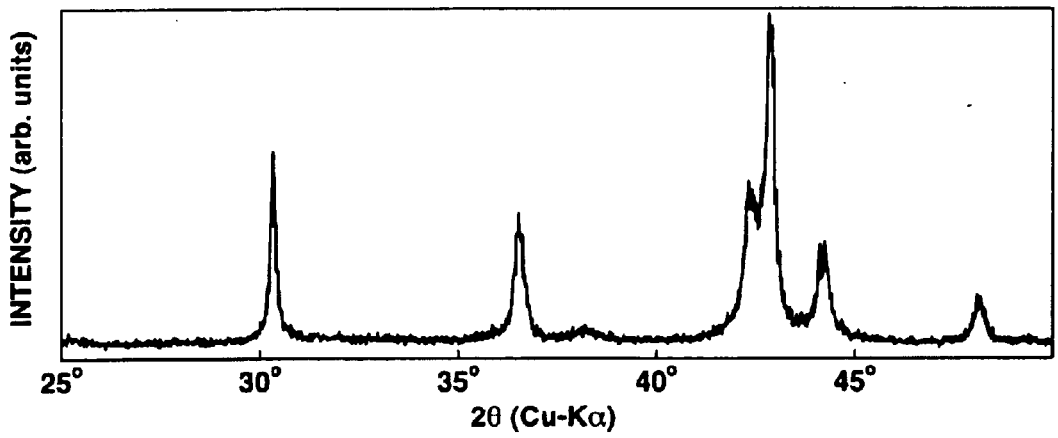
FIG. 19 is an x-ray diffraction pattern for the $Sm_2Co_{17}$-based magnet alloy produced in Example 8.
Figure 20:
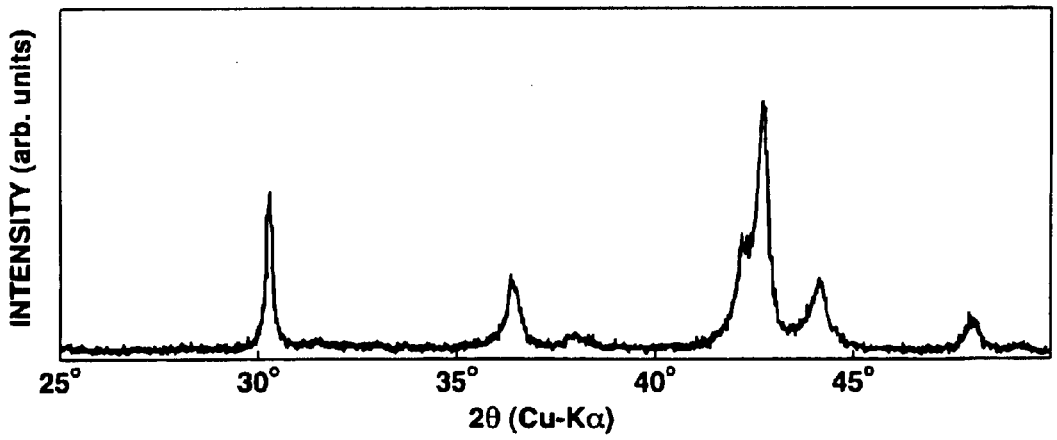
FIG. 20 is an x-ray diffraction pattern for the $Sm_2Co_{17}$-based magnet alloy produced in Example 9.
Figure 21:
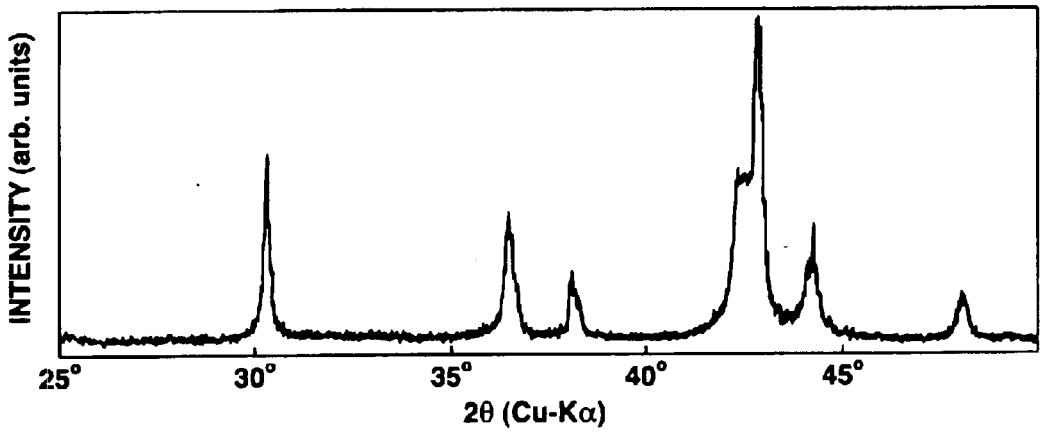
FIG. 21 is an x-ray diffraction pattern for the $Sm_2Co_{17}$-based magnet alloy produced in Comparative Example 9.
Figure 22:
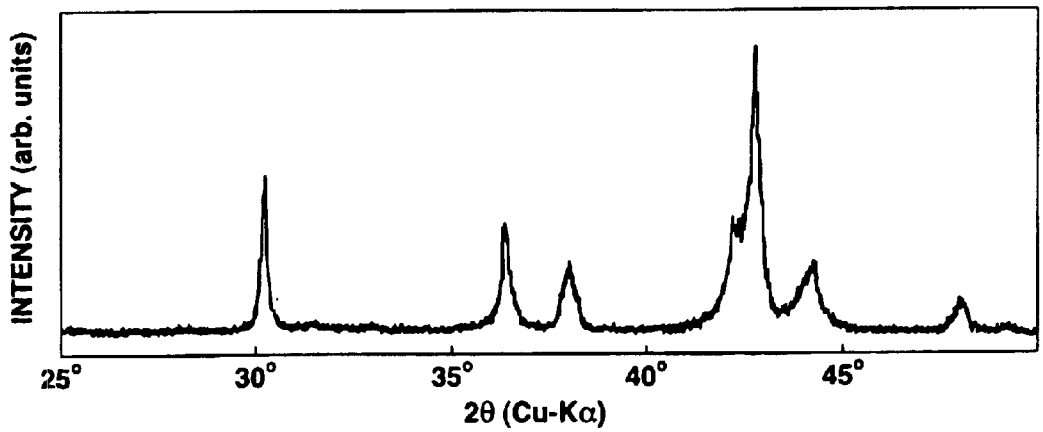
FIG. 22 is an x-ray diffraction pattern for the $Sm_2Co_{17}$-based magnet alloy produced in Comparative Example 10.
Figure 23:
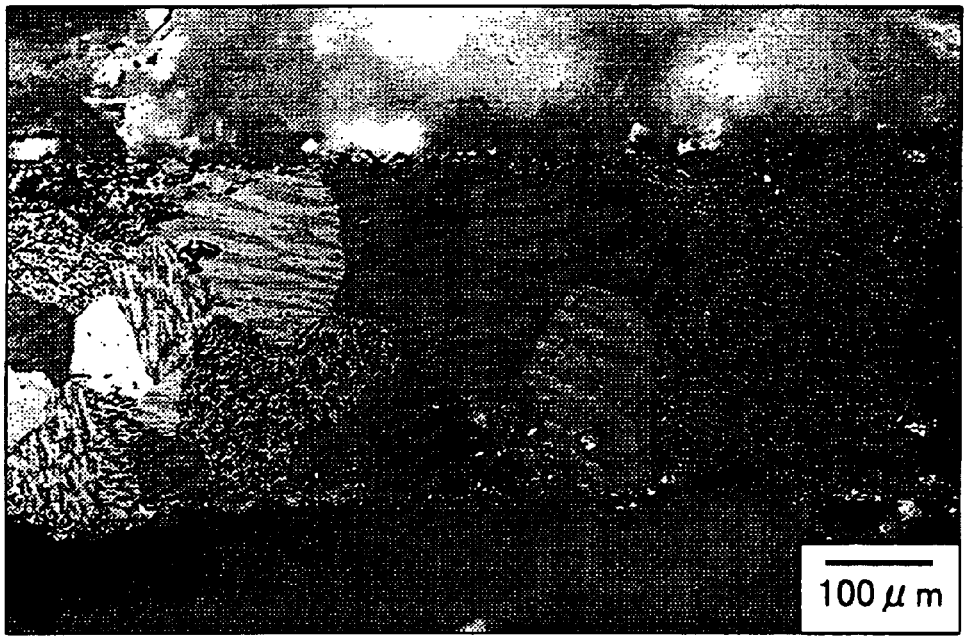
FIG. 23 is a polarizing microscope image of the magnet material produced in Example 8.
Figure 24:
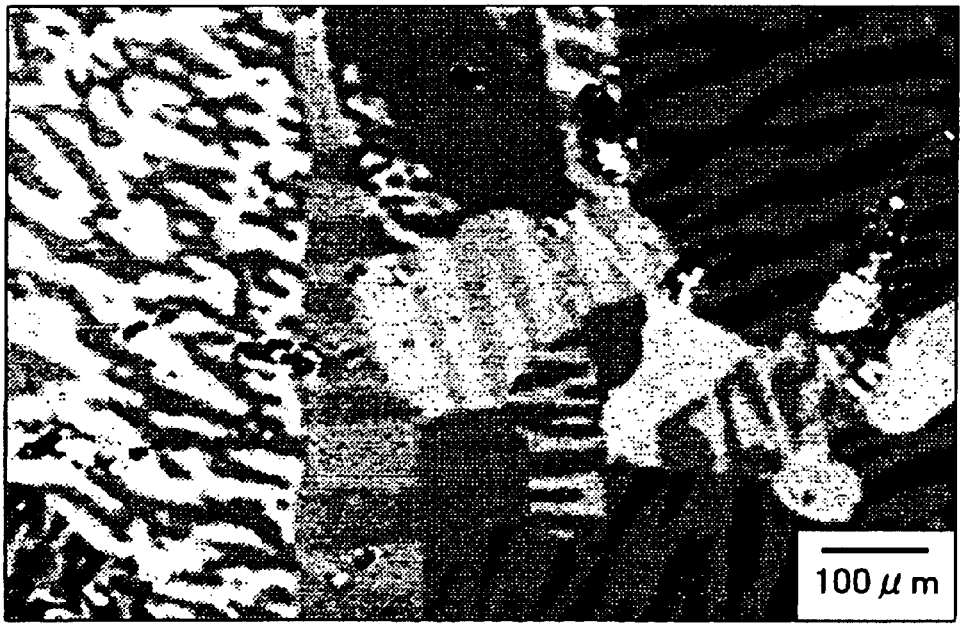
FIG. 24 is a polarizing microscope image of the magnet material produced in Example 9.
Figure 25:
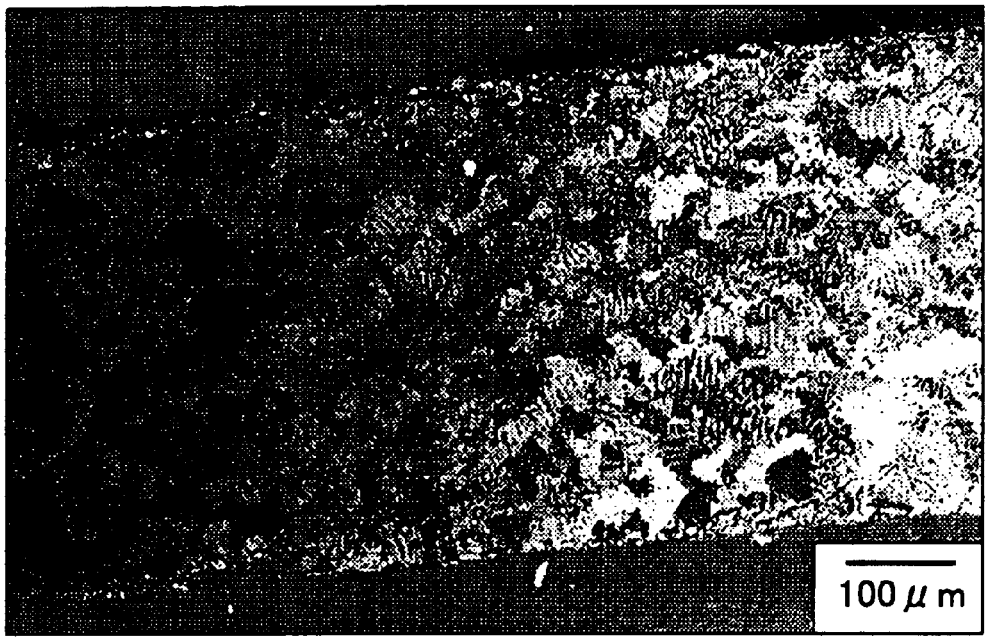
FIG. 25 is a polarizing microscope image of the magnet material produced in Comparative Example 9.
Figure 26:
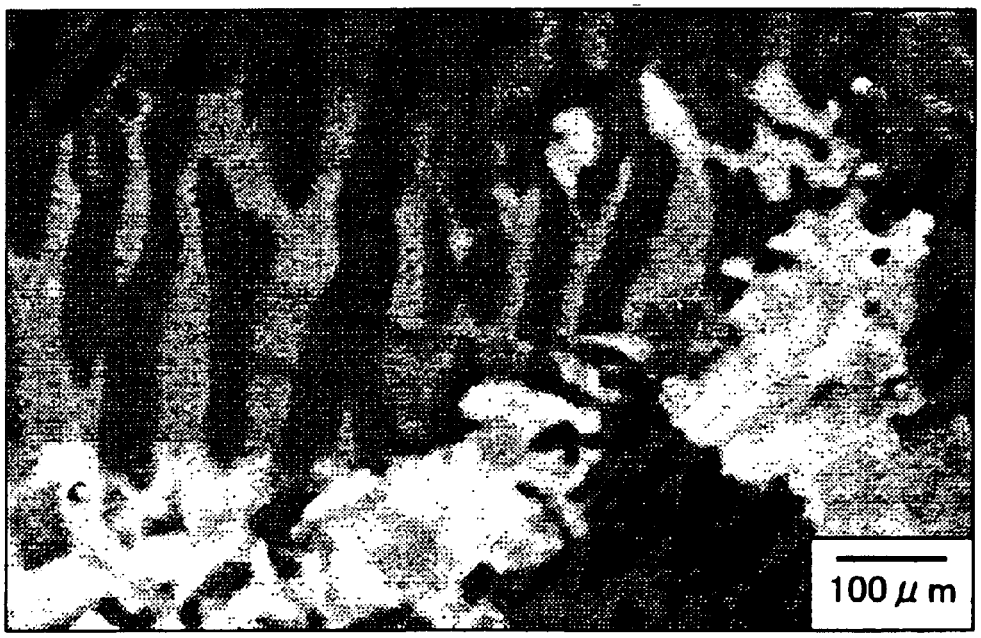
FIG. 26 is a polarizing microscope image of the magnet material produced in Comparative Example 10.

Table 5 and FIGS. 17 and 18 show the magnetic properties and demagnetization curves for the sintered magnets produced in Examples 5 to 7 and Comparative Examples 7 to 9. As is apparent from these results, the sintered magnets produced from the magnet alloys according to the present invention had better residual flux densities and maximum energy products than magnet alloys cast in a copper box-type mold. The results also show that the magnetic properties of the magnets were stable within the sintering temperature ranges in Examples 5 to 7 and Comparative Examples 7 to 9.

TABLE 5

| | Sintering temperature (° C.) | Br (kG) | HcJ (kOe) | $(BH)_{max}$ (MGOe) |
|---|---|---|---|---|
| Example 5 | 1180 | 11.6 | 14.3 | 31.1 |
| Example 6 | 1175 | 11.6 | 14.7 | 30.8 |
| Example 7 | 1185 | 11.6 | 14.0 | 30.9 |
| Comparative Example 7 | 1180 | 11.2 | 14.3 | 27.6 |
| Comparative Example 8 | 1175 | 11.2 | 14.6 | 25.4 |
| Comparative Example 9 | 1185 | 11.2 | 12.7 | 28.0 |

Example 8

A $Sm_2Co_7$-based magnet ingot was produced by formulating a starting material composed of 25.5 wt % samarium, 15.0 wt % iron, 5.0 wt % copper, 2.5 wt % zirconium and 0.1 wt % titanium, with the balance being cobalt. The composition was placed in an alumina crucible and melted in an induction furnace under an argon gas atmosphere, following which the melt was strip-cast using a single water-cooled roll (circumferential speed of roll, 1.5 m/s; cooling rate, −2000° C./s). The resulting samarium-cobalt-based magnet alloy was heat-treated in a heat treatment furnace under an argon atmosphere at 1180° C. for 2 hours. Following the completion of heat treatment, the ingot was quenched. The constituent phases of the resulting $Sm_2Co_{17}$-based magnet alloy was identified by x-ray diffraction analysis (Cu Kα), and the proportion of 1:7 phase among the constituent phases was measured. In addition, the alloy structure was examined under a polarizing microscope and the average crystal grain size was measured. The proportion of 1:7 phase was determined by comparing the peak intensity for $Th_2Zn_7$-type crystal structures with the peak intensity for $TbCu_7$-type crystal structures in the x-ray diffraction pattern.

The above samarium-cobalt-based magnet alloy was crushed to a size of about 500 μm or less with a jaw crusher and Brown mill, then milled to an average particle size of about 5 μm with a jet mill using a stream of nitrogen gas. Next, the milled alloy was molded in a press under a pressure of 1.5 t/cm$^2$ while being subjected to a magnetic field of 15 kOe. The resulting powder compacts were sintered in a heat treatment furnace at 1200° C. for 2 hours under an argon atmosphere, after which 1 hour of solution treatment was carried out in argon at 1180° C. Following the completion of solution treatment, the sintered compacts were quenched, then each was held in an argon atmosphere at 800° C. for 10 hours and gradually cooled to 400°C. at a rate of −1.0° C./min, thereby giving sintered magnets. The magnetic properties of the resulting sintered magnets were measured with a BH tracer.

Example 9

Starting materials of the same composition as in Example 8 were placed in an alumina crucible and melted in an induction furnace under an argon atmosphere, then cast in a copper box-like mold so as to give a $Sm_2Co_{17}$-based magnet alloy having a thickness of 3 mm. The resulting $Sm_2Co_{17}$-based magnet alloy was heat-treated as in Example 8. Following the completion of heat treatment, the ingot was quenched. The constituent phases of the resulting $Sm_2Co_{17}$-based magnet alloy was identified by x-ray diffraction analysis (Cu Kα), and the proportion of 1:7 phase among the constituent phases was measured. In addition, the alloy structure was examined under a polarizing microscope and the average crystal grain size was measured.

The resulting $Sm_2Co_7$-based magnet alloy was then subjected to crushing, milling, molding in a magnetic field, sintering, solution treatment, and aging treatment by the same methods as described above in Example 8, thereby producing a sintered magnet. The magnetic properties of the resulting sintered magnet were measured in the same way as in Example 8.

Comparative Example 9

An alloy of the same composition as in Example 8 was manufactured by the same casting method. However, heat treatment was not carried out after casting. The constituent phases of the resulting $Sm_2Co_{17}$-based magnet alloy were identified by x-ray diffraction analysis (Cu Kα) and the proportion of 1:7 phase measured as in Example 8. In addition, the microstructure was examined under a polarizing microscope and the average crystal grain size was measured.

The resulting $Sm_2Co_7$-based magnet alloy was then subjected to crushing, milling, molding in a magnetic field, sintering, solution treatment, and aging treatment by the same methods as described above in Example 8, thereby producing a sintered magnet. The magnetic properties of the resulting sintered magnet were measured in the same way as in Example 8.

Comparative Example 10

Starting materials of the same composition as in Example 8 were placed in an alumina crucible and melted in an induction furnace under an argon atmosphere, then cast in a copper box-like mold so as to give a $Sm_2Co_{17}$-based magnet alloy having a thickness of 15 mm. However, heat treatment was not carried out after casting. The constituent phases of the resulting $Sm_2Co_{17}$-based magnet alloy were identified by x-ray diffraction analysis (Cu Kα), and the proportion of 1:7 phase among the constituent phases was measured as in Example 8. In addition, the microstructure was examined under a polarizing microscope and the average crystal grain size was measured.

The resulting $Sm_2Co_{17}$-based magnet alloy was then subjected to crushing, milling, molding in a magnetic field, sintering, solution treatment, and aging treatment by the same methods as described above in Example 8, thereby producing a sintered magnet. The magnetic properties of the resulting sintered magnet were measured in the same way as in Example 8.

Table 6 below shows the proportions of 1:7 phase and the average grain sizes within the respective alloys prepared in Examples 8 and 9 and Comparative Examples 9 and 10, as well as the magnetic properties of the sintered magnets obtained from each of these alloys. It is apparent from these results that the sintered magnets produced from the magnet alloys obtained in Examples 8 and 9 which contained a high proportion of 1:7 phase had a better residual flux density and maximum energy product than the sintered magnets produced in Comparative Examples 9 and 10. X-ray diffraction patterns and polarizing microscope images for Examples 8 and 9 and Comparative Examples 9 and 10 are shown in FIGS. 19 to 26.

TABLE 6

| | 1:7 phase content in alloy (vol %) | Average grain size of alloy (μm) | Br (kG) | HcJ (kOe) | $(BH)_{max}$ (MGOe) |
|---|---|---|---|---|---|
| Example 8 | 75 | 50 | 10.7 | 15.1 | 27.2 |
| Example 9 | 65 | 300 | 10.6 | 15.9 | 26.8 |
| Comparative Example 9 | 35 | 10 | 9.5 | 17.2 | 19.1 |
| Comparative Example 10 | 35 | 350 | 10.4 | 15.5 | 24.5 |

The $Sm_2Co_{17}$-based sintered magnets of the invention have excellent magnetic properties, and can be produced within a broader optimal temperature range in sintering and solution treatment than is possible in the prior art. Moreover, such anisotropic rare-earth sintered magnets have a maximum energy product of 25 MGOe or more.

Japanese Patent Application Nos. 2000-272658, 2000-272665, 2000-272667 and 2000-273194 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A rare-earth alloy ingot made by melting an alloy consisting essentially of 20 to 30 wt % of a rare-earth constituent R which is samarium alone or is at least 50 wt % samarium in combination with at least one other rare-earth element, 10 to 45 wt % of iron, 1 to 10 wt % of copper and 0.5 to 5 wt % of zirconium, with the balance being cobalt, and quenching the molten alloy in a strip casting process;

which ingot has a content of 1 to 200 μm size equiaxed crystal grains of at least 20 vol % and a thickness of 0.05 to 3 mm.

2. A method of manufacturing a rare-earth alloy ingot, comprising the steps of:

melting an alloy consisting essentially of 20 to 30 wt % of a rare-earth constituent R which is samarium alone or is at least 50 wt % samarium in combination with at least one other rare-earth element, 10 to 45 wt % of iron, 1 to 10 wt % of copper and 0.5 to 5 wt % of zirconium, with the balance being cobalt; and strip-casting the molten alloy at a melt temperature of 1250 to 1600° C. to form a rare-earth alloy ingot which has a content of 1 to 200 μm size equiaxed crystal grains of at least 20 vol % and a thickness of 0.05 to 3 mm.

3. A rare-earth alloy ingot according to claim 1, wherein the rare-earth element other than samarium is neodymium, cerium, praseodymium or gadolinium.

4. A rare-earth alloy ingot according to claim 1, wherein crystal grain size is 5 to 100 μm.

5. A rare-earth alloy ingot according to claim 1, wherein the ingot has a content of equiaxed crystal grains of at least 30 vol %.

6. A rare-earth alloy ingot according to claim 1, wherein the ingot has a content of equiaxed crystal grains of at least 40 vol %.

7. A rare-earth alloy ingot according to claim 1, wherein the thickness of the ingot is 0.1 to 1 mm.

8. A method according to claim 2, wherein the rare-earth element other than samarium is neodymium, cerium, praseodymium or gadolinium.

9. A method according to claim 2, wherein crystal grain size is 5 to 100 μm.

10. A method according to claim 2, wherein the ingot has a content of equiaxed crystal grains of at least 30 vol %.

11. A method according to claim 2, wherein the ingot has a content of equiaxed crystal grains of at least 40 vol %.

12. A method according to claim 2, wherein the thickness of the ingot is 0.1 to 1 mm.

13. A method according to claim 2, wherein strip-casting the molten alloy takes place at a melt temperature of 1300 to 1600° C.

* * * * *